US010339745B2

(12) United States Patent
Kuroda et al.

(10) Patent No.: US 10,339,745 B2
(45) Date of Patent: Jul. 2, 2019

(54) BANKNOTE STORING DEVICE AND BANKNOTE HANDLING MACHINE

(71) Applicant: GLORY LTD., Himeji-shi, Hyogo (JP)

(72) Inventors: Toshiyuki Kuroda, Himeji (JP); Eiki Yamamoto, Himeji (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 15/815,924

(22) Filed: Nov. 17, 2017

(65) Prior Publication Data

US 2018/0137713 A1 May 17, 2018

(30) Foreign Application Priority Data

Nov. 17, 2016 (JP) ..... 2016-224302

(51) Int. Cl.

| | |
|---|---|
| ***G07F 7/04*** | (2006.01) |
| ***G07D 11/18*** | (2019.01) |
| ***G07D 11/13*** | (2019.01) |
| ***G07D 11/125*** | (2019.01) |
| ***G07D 11/12*** | (2019.01) |
| *B65H 29/00* | (2006.01) |

(52) U.S. Cl.

CPC ..... *G07D 11/18* (2019.01); *G07D 11/12* (2019.01); *G07D 11/125* (2019.01); *G07D 11/13* (2019.01); *B65H 29/006* (2013.01); *B65H 2301/41912* (2013.01); *G07D 2211/00* (2013.01)

(58) Field of Classification Search

CPC ..... G07D 11/0006; G07D 11/0012; G07F 7/049; G07F 9/10; G07F 19/00; G07F 19/205; B65H 2701/1912

See application file for complete search history.

(56) References Cited

U.S. PATENT DOCUMENTS 8,857,596 B2 * 10/2014 Ito ..... G07F 19/203 194/206
2008/0121705 A1 5/2008 Ma et al.
2012/0048877 A1 * 3/2012 Rennie ..... G07D 11/0006 221/1
2012/0103754 A1 5/2012 Robinson et al.

(Continued)

FOREIGN PATENT DOCUMENTS

WO WO 2004/070668 A1 8/2004

OTHER PUBLICATIONS

European Search Report (Application No. 17201982.0) (9 pages—dated Mar. 18, 2014).

(Continued)

*Primary Examiner* — Mark J Beauchaine
(74) *Attorney, Agent, or Firm* — Renner, Kenner, Greive, Bobak, Taylor & Weber

(57) ABSTRACT

A banknote storing device (for example, a storing and feeding unit (20)), includes a plurality of banknote storing mechanism (24, 26) arranged inside a casing (20*a*) side by side along a depth direction of the casing (20*a*). When viewed in a predetermined direction that is a direction orthogonal to the depth direction of the casing (20*a*) and also orthogonal to an axis direction of rotating members (for example, drums (24*a*, 26*a*)), at least one of the rotating members is arranged at a position at which the rotating member does not overlap with any of winding member accommodating units (for example, reels (25*a*, 25*b*, 27*a*, 27*b*)).

18 Claims, 10 Drawing Sheets

(56) References Cited

U.S. PATENT DOCUMENTS

| | | | | |
|---|---|---|---|---|
| 2012/0241283 | A1* | 9/2012 | Sakamoto | G07D 11/0072 194/302 |
| 2015/0021385 | A1 | 1/2015 | Michels et al. | |
| 2015/0298928 | A1* | 10/2015 | Iwasaki | B65H 29/006 242/397 |
| 2017/0297842 | A1* | 10/2017 | Yanagida | B65H 5/28 |
| 2017/0355543 | A1* | 12/2017 | Arikata | B65H 29/006 |

OTHER PUBLICATIONS

Australian Examination Report (Application No. 2017261558) (3 pages—dated Jul. 11, 2018).

* cited by examiner

BANKNOTE STORING DEVICE AND BANKNOTE HANDLING MACHINE

CROSS-REFERENCE TO RELATED APPLICATION

This application claims priority to Japanese Patent Application No. 2016-224302 filed on Nov. 17, 2016, the entire contents of which are incorporated herein by reference.

BACKGROUND OF THE INVENTION

1. Field of the Invention

The present invention relates to a banknote storing device that can store banknotes and feed the stored banknotes, and to a banknote handling machine including such a banknote storing device.

2. Description of the Related Art

Various types of banknote storing devices that can store banknotes and feed the stored banknotes are known in the art. A tape-reel style banknote storing device is available in which banknotes are wound on a drum along with tapes, and the banknotes are fed by unwinding the tapes from the drum. Published U.S. Patent Application No. 2015/021385 (US 2015/021385A) discloses a banknote storing device in which two combination members each including a drum and a reel are arranged in one casing, and in which banknotes can be stored in each of the combination members.

In the banknote storing device disclosed in Published U.S. Patent Application No. 2015/021385, at least a part of the reels and the drums overlaps in an up-down direction. In this configuration, because the length of the casing in the up-down direction is previously fixed, and because a diameter of an outer peripheral edge of the outermost tape wound on the drum when the banknotes of the maximum storable number are stored in the combination member needs to be kept small, there is a problem that the maximum number of the banknotes that could be wound on each of the drums (i.e., a maximum storable banknote number) is relatively small.

SUMMARY OF INVENTION

The present invention has been made in view of the above discussion. It is one object of the present invention to provide a banknote storing device and a banknote handling machine in which it is possible to increase the maximum storable banknote number.

A banknote storing device of the present invention includes: a casing; and a plurality of banknote storing mechanisms arranged inside the casing side by side along a depth direction of the casing and each of which capable of storing banknotes sent from outside of the casing to inside thereof and feeding stored banknotes from the inside of the casing to the outside thereof, and each of the banknote storing mechanisms includes a rotating member that rotates around an axis orthogonal to the depth direction; a belt-shaped winding member with a first end of two ends thereof connected to the rotating member; and a winding member accommodating unit to which a second end of the two ends of the winding member is connected and that is capable of accommodating the winding member, and each of the banknote storing mechanisms stores therein the banknotes by winding the banknotes on the rotating member together with the winding member and feeds the banknotes one by one by unwinding the winding member wound on the rotating member from the rotating member, and at least one of the rotating members is arranged at a position at which the rotating member does not overlap with any of the winding member accommodating units when viewed in a predetermined direction orthogonal to the depth direction of the casing and also orthogonal to an axis direction of the rotating members.

In the banknote storing device of the present invention, all the rotating members may be arranged at positions at which the rotating members do not overlap with any of the winding member accommodating units in the predetermined direction.

Further, each of the banknote storing mechanisms may include a driving unit that rotationally drives at least one of the rotating member and the winding member accommodating unit, and at least one of the rotating members may be arranged at a position at which the rotating member does not overlap with any of the driving units in the predetermined direction.

In the banknote storing device of the present invention, in at least one of the banknote storing mechanisms, an outer peripheral edge of the winding member wound on the rotating member when a maximum number of the banknotes are stored in the banknote storing mechanism may not overlap with any of the winding member accommodating units in the predetermined direction.

In this case, in all the banknote storing mechanisms, the outer peripheral edge of the winding member wound on the rotating member when the maximum number of the banknotes are stored in the banknote storing mechanism may not overlap with any of the winding member accommodating units in the predetermined direction.

In the banknote storing device of the present invention, in all the banknote storing mechanisms, an outer peripheral edge of the winding member wound on the rotating member when the maximum number of the banknotes are stored in the banknote storing mechanism may overlap at least partially with at least some of the winding member accommodating units in the depth direction of the casing.

In this case, each of the banknote storing mechanisms may include a driving unit that rotationally drives at least one of the rotating member and the winding member accommodating unit, and in all the rotating members, an outer peripheral edge of the winding member wound on the rotating member when the maximum number of the banknotes are stored in the banknote storing mechanism may overlap at least partially with at least some of the driving units in the depth direction of the casing.

In the banknote storing device of the present invention, in at least one of the banknote storing mechanisms, the winding member accommodating unit may be arranged further inside in the depth direction of the casing than the rotating member to which is connected the first end of the winding member while the second end thereof is connected to the winding member accommodating unit.

In this case, in all the banknote storing mechanisms, the winding member accommodating unit may be arranged further inside in the depth direction of the casing than the rotating member to which is connected the first end of the winding member while the second end thereof is connected to the winding member accommodating unit.

In the banknote storing device of the present invention, each of the banknote storing mechanisms may include a driving unit that rotationally drives at least one of the rotating member and the winding member accommodating unit, and in at least one of the banknote storing mechanisms, the driving unit may be arranged further inside in the depth direction of the casing than the rotating member that is rotationally driven by the driving unit.

Further, all the winding member accommodating units may be arranged around the rotating member that is arranged further inside in the depth direction of the casing among the rotating members.

In this case, all the driving units may be arranged around the rotating member that is arranged further inside in the depth direction of the casing among the rotating members.

In the banknote storing device of the present invention, the casing may have a substantially rectangular parallelepiped shape, a long-side direction of any rectangular side surface of the casing having a largest surface area may correspond to the depth direction of the casing, and the predetermined direction may be a direction along a surface orthogonal to the axis direction of the rotating members and also a direction along a surface orthogonal to the long side of any rectangular side surface of the casing having the largest surface area.

In this case, two banknote storing mechanisms may be arranged inside the casing, and a ratio of a length of a long side to a length of a short side of a side surface of the casing orthogonal to the axis direction of the rotating members may be between 2 and 3.

In the banknote storing device of the present invention, a maximum number of the banknotes that is capable of being wound on the rotating member arranged further inside in the depth direction of the casing may be larger than a maximum number of the banknotes that is capable of being wound on the rotating member arranged in a front side in the depth direction of the casing.

A banknote handling machine of the present invention includes: a transport unit that transports banknotes; and the banknote storing device as claimed in any one of claims 1 to 15, and the banknotes sent to the banknote storing device by the transport unit is stored in one of the banknote storing mechanisms, and banknotes fed from any one of the banknote storing mechanisms is sent to the transport unit.

In this case, a plurality of banknote storing devices may be arranged parallel to each other.

BRIEF DESCRIPTION OF DRAWINGS

FIG. 6 is a side view of a unit configuration of the storing and feeding unit shown in FIG. 4 and the like.

FIG. 8A is a view indicating a positional relationship among the drums, reels, and motors in the storing and feeding unit shown in FIG. 4 and the like.

FIG. 8B is a view indicating a positional relationship among the drums, the reels, and the motors in the storing and feeding unit shown in FIG. 4 and the like.

FIG. 8C is a view indicating a positional relationship among the drums, the reels, and the motors in the storing and feeding unit shown in FIG. 4 and the like.

FIG. 8D is a view indicating a positional relationship among the drums, the reels, and the motors in the storing and feeding unit shown in FIG. 4 and the like.

DESCRIPTION OF EMBODIMENT

Figure 1:
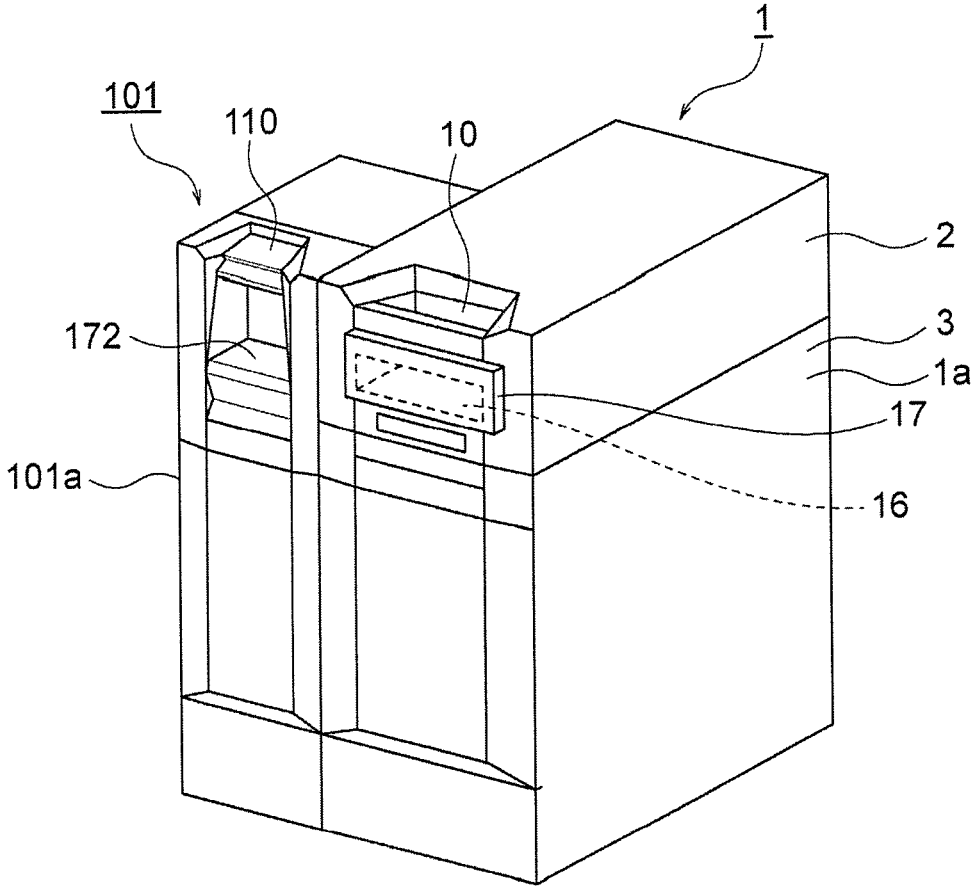
FIG. 1 is a perspective view of an external appearance of a money handling system according to an embodiment of the present invention.
Figure 2:
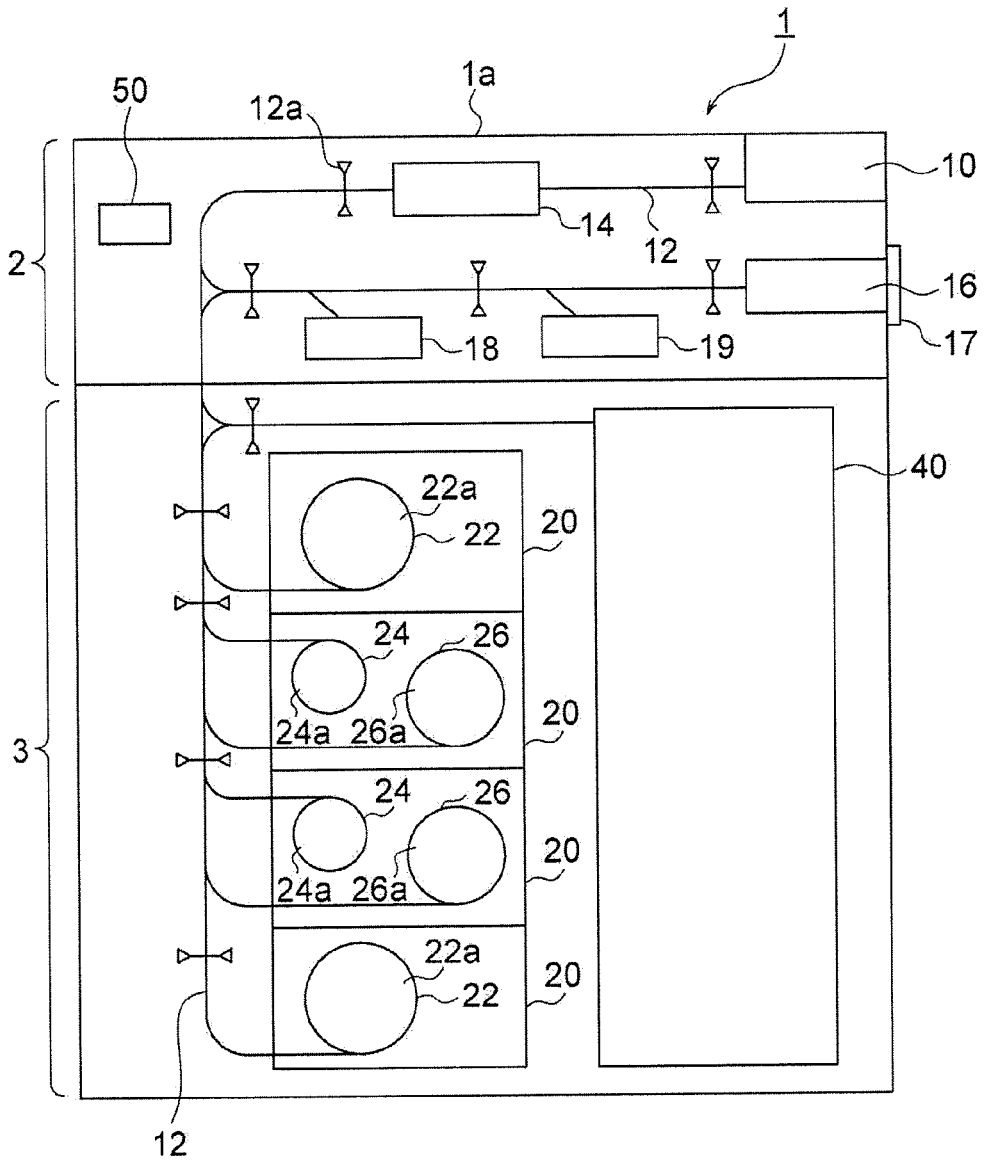
FIG. 2 is a side view of an internal configuration of a banknote handling machine included in the money handling system shown in FIG. 1.
Figure 3:
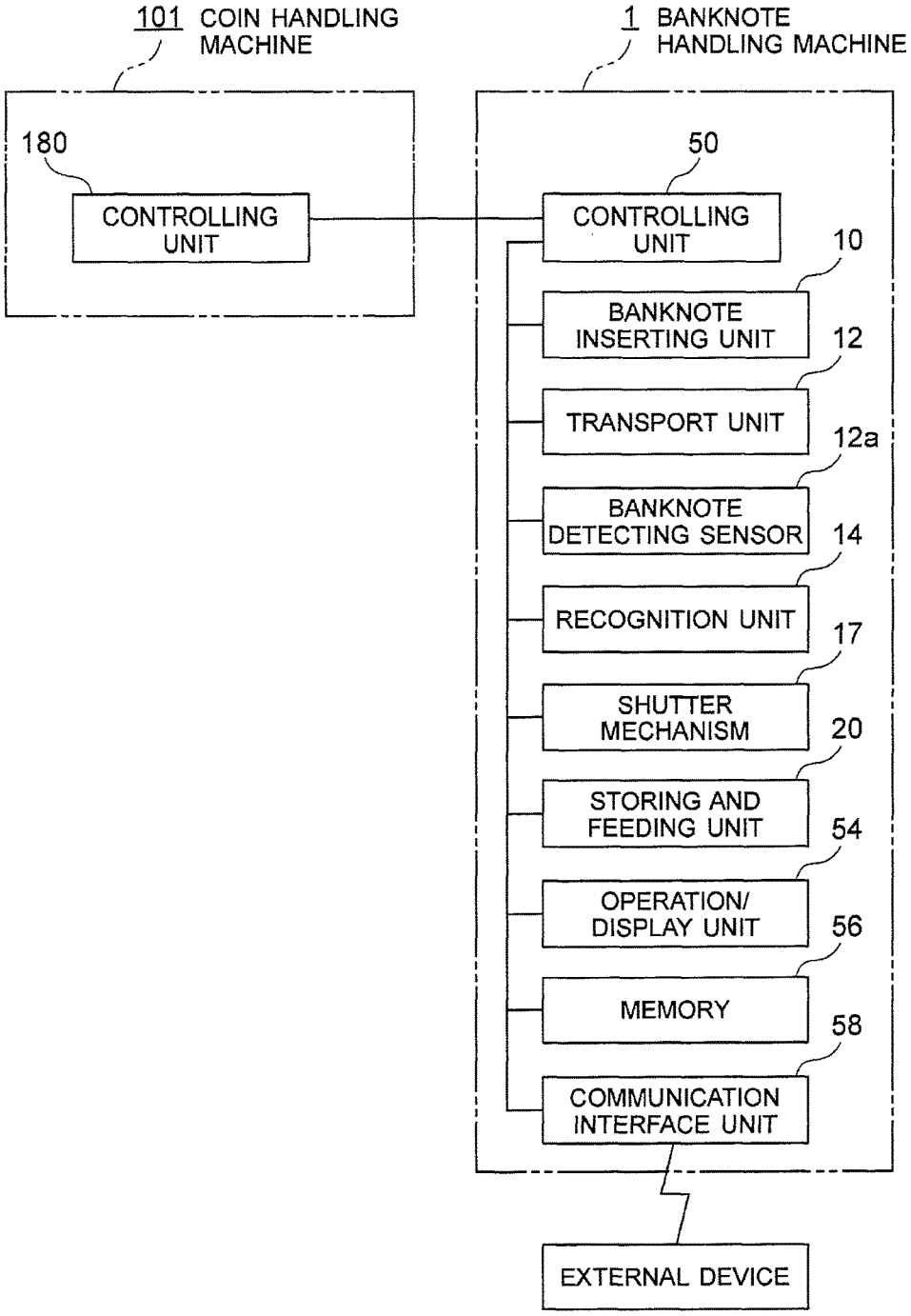
FIG. 3 is a functional block diagram indicating a configuration of a control system of the money handling system shown in FIG. 1.
Figure 4:
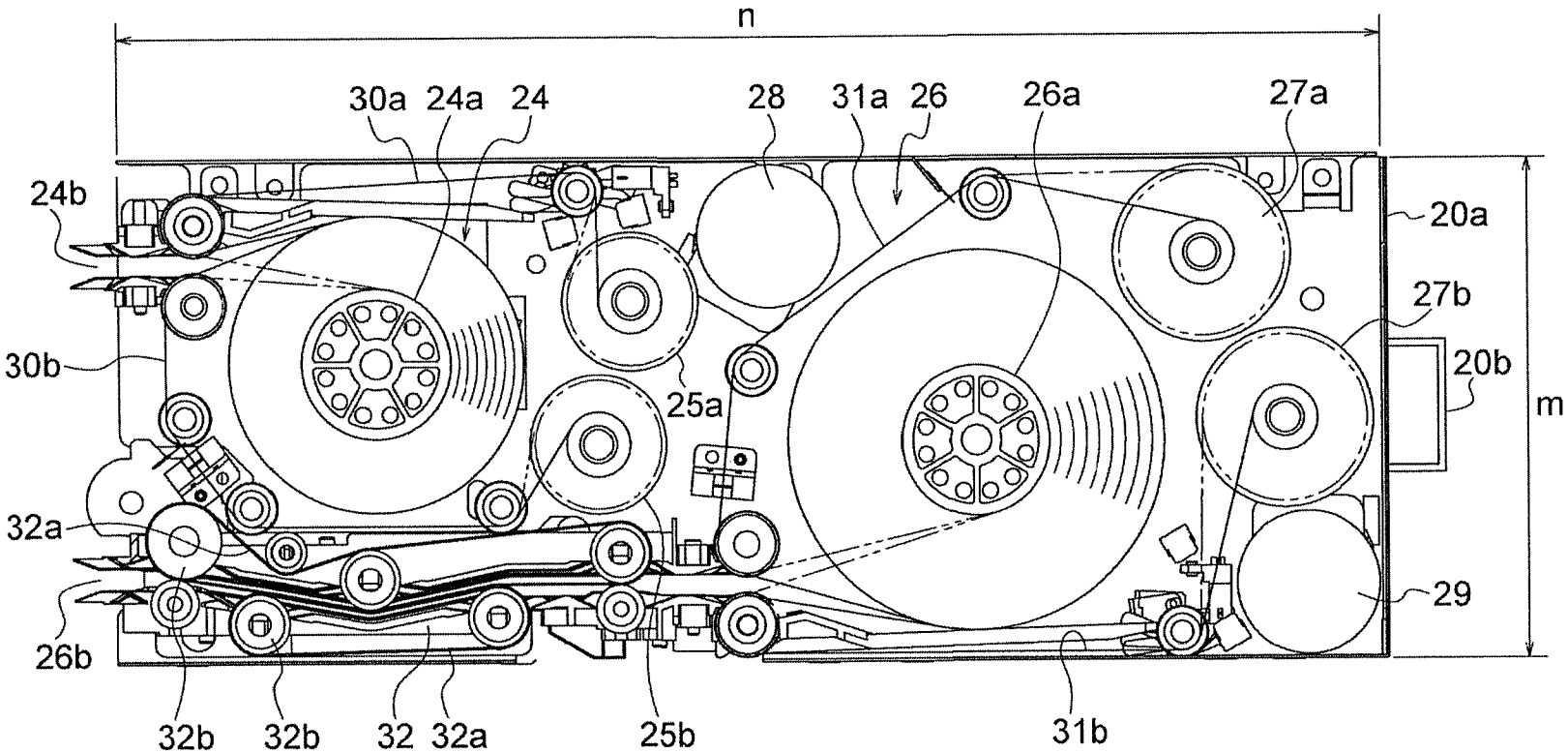
FIG. 4 is a side view of a detailed configuration of a storing and feeding unit having two drums included in the money handling system shown in FIG. 1.
Figure 5:
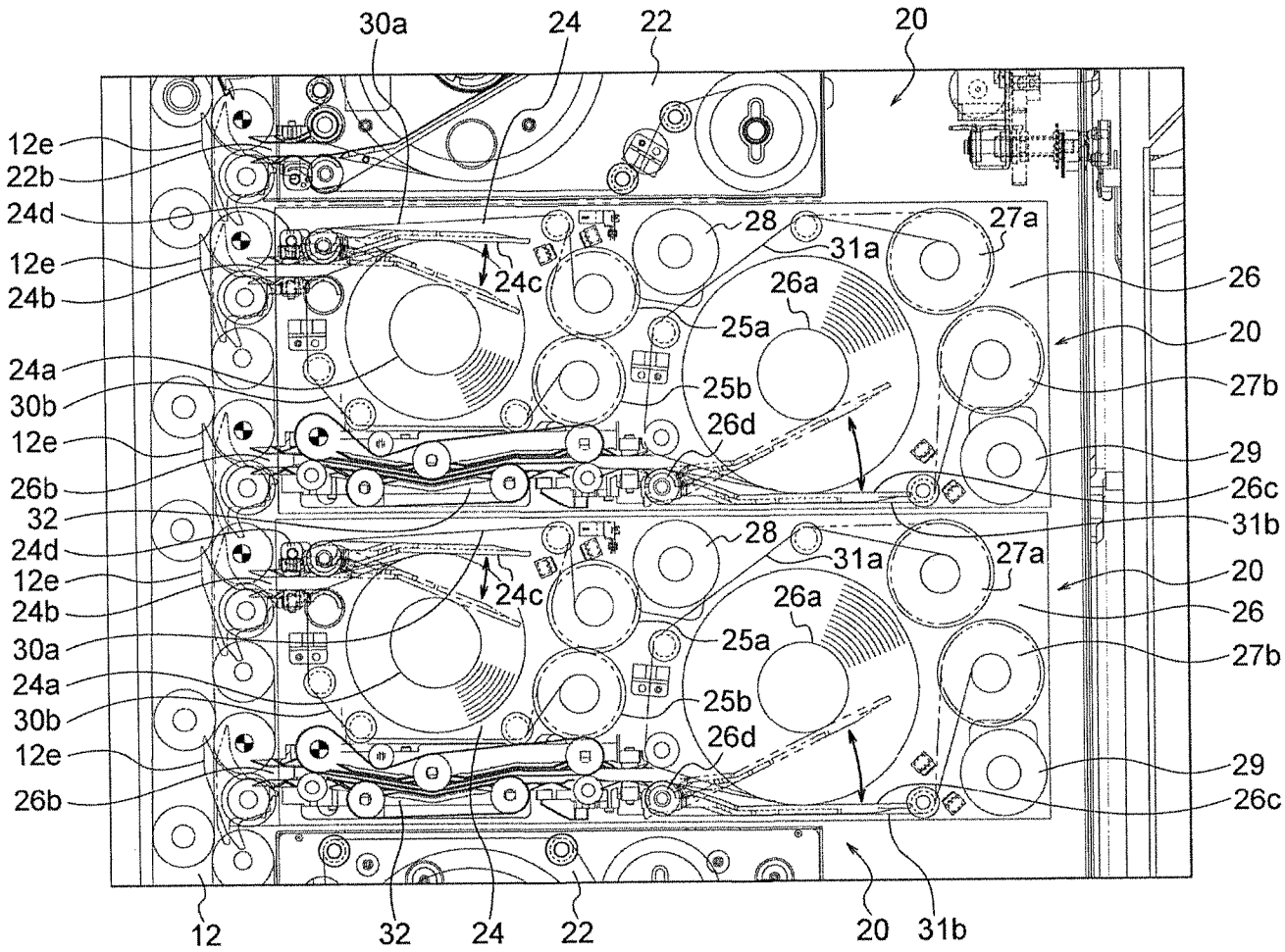
FIG. 5 is a side view of a configuration of each of the storing and feeding units and a transport unit included in the money handling system shown in FIG. 1.
Figure 6:
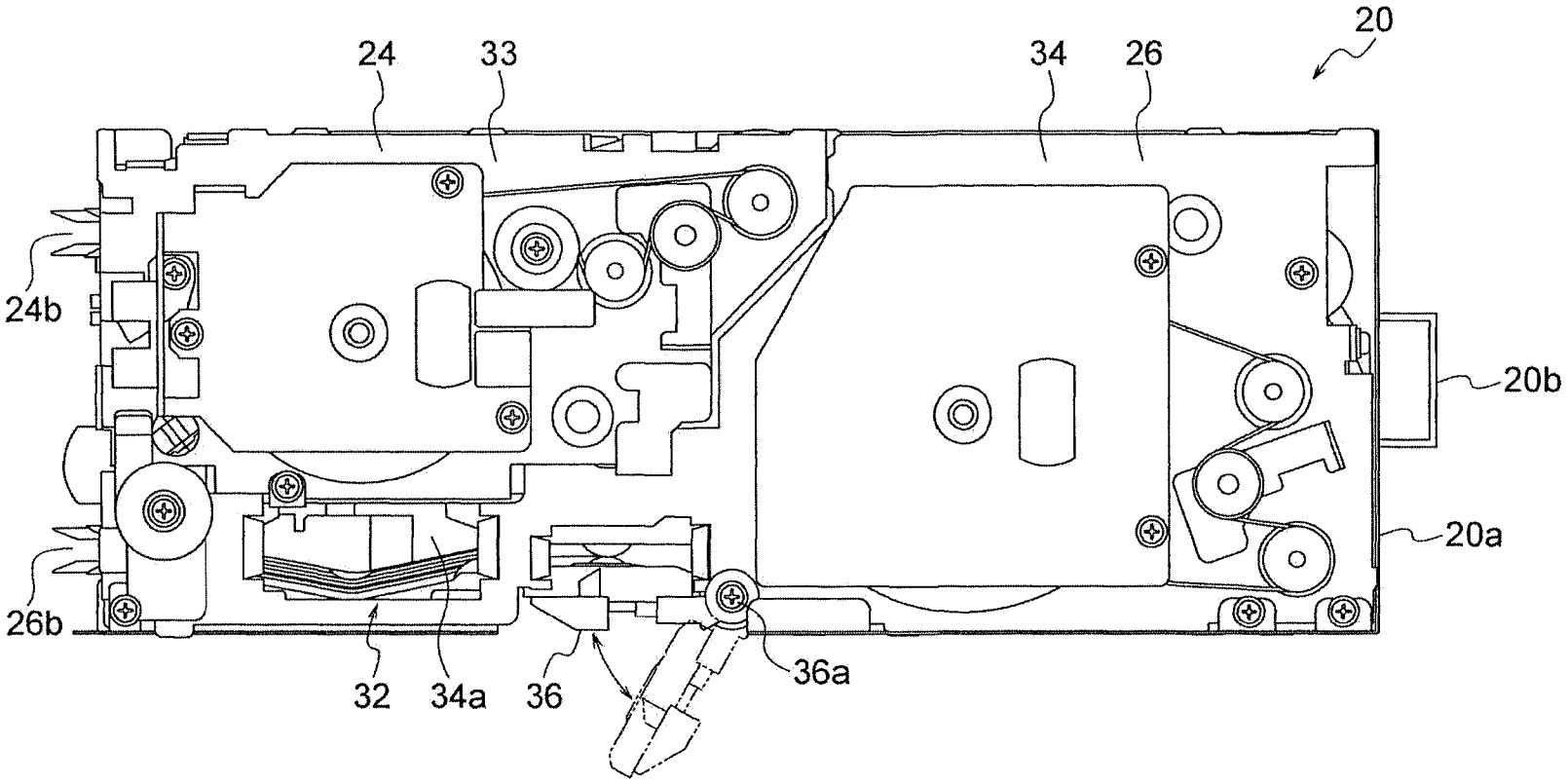
Figure 7:
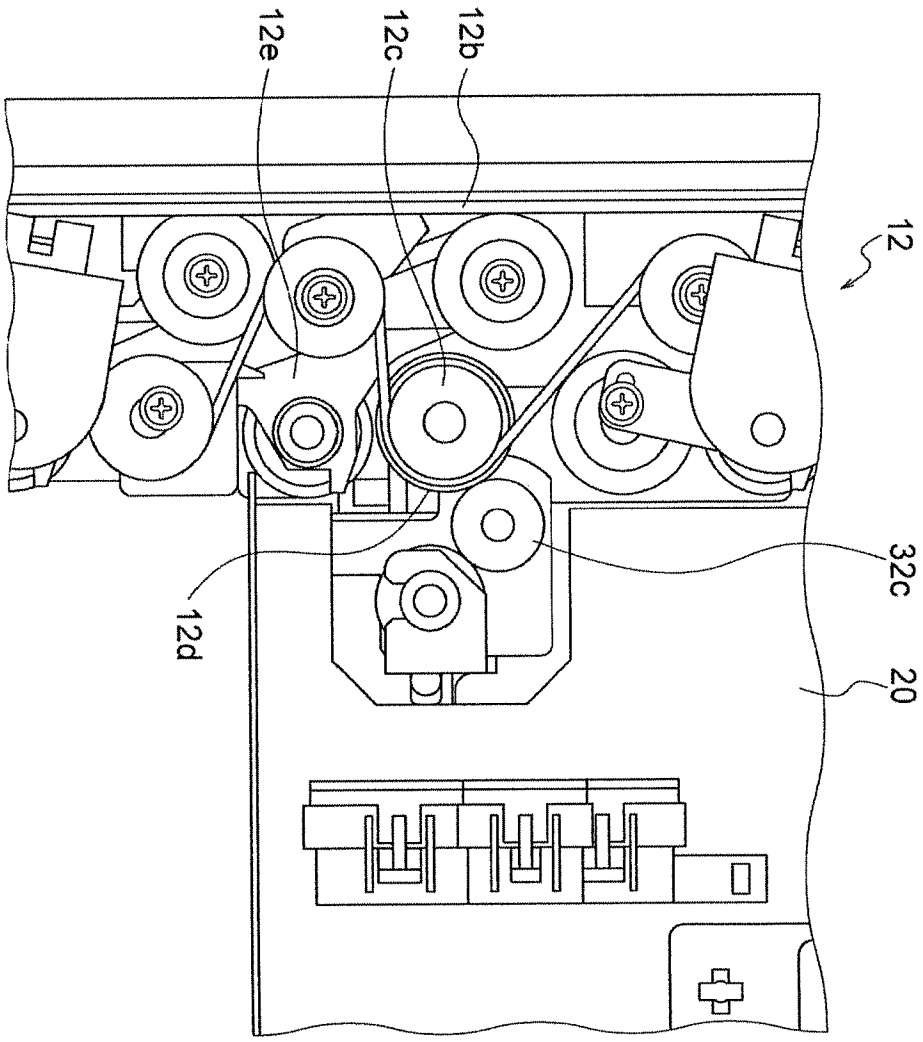
FIG. 7 is a side view of a configuration of a transmission mechanism for transmitting power from the transport unit to the storing and feeding unit in the banknote handling machine of the money handling system shown in FIG. 1.

Exemplary embodiments of the present invention are explained below with reference to the accompanying drawings. FIGS. 1 to 9D are views indicating a money handling system according to the present embodiment. Among these, FIG. 1 is a perspective view of an external appearance of a money handling system according to an embodiment of the present invention, FIG. 2 is a side view of an internal configuration of a banknote handling machine included in the money handling system shown in FIG. 1, and FIG. 3 is a functional block diagram of a configuration of a control system of the money handling system shown in FIG. 1. FIG. 4 is a side view of a detailed configuration of a storing and feeding unit having two drums in the money handling system shown in FIG. 1, and FIG. 5 is a side view of a configuration of each of the storing and feeding units and a transport unit in the money handling system shown in FIG. 1. FIG. 6 is a side view of a unit configuration of the storing and feeding unit shown in FIG. 4 and the like, and FIG. 7 is a side view of a configuration of a transmission mechanism for transmitting power from the transport unit to the storing and feeding unit in the banknote handling machine of the money handling system shown in FIG. 1. FIGS. 8A to 8D are views indicating a positional relationship among drums, reels, and motors in the storing and feeding unit shown in FIG. 4 and the like, and FIGS. 9A to 9D are views indicating a banknote denomination and the like linked with a banknote storing mechanism of each of the storing and feeding units in the banknote handling machine of the money handling system shown in FIG. 1.

The money handling system according to the present embodiment is arranged in a shop such as a supermarket or a convenience store, and performs a money deposition process of banknotes and coins as proceeds of sales. In addition, the money handling system performs the money dispensing process of banknotes and coins as money change. As shown in FIG. 1, the money handling system according to the present embodiment includes a banknote handling machine 1 and a coin handling machine 101. The banknote handling machine 1 and the coin handling machine 101 are arranged side by side. A not-shown POS register is communicably connected to the banknote handling machine 1 via a LAN and the like. A check-out counter (a table and/or a counter) that separates a clerk from a customer is arranged in a check-out place in the shop. The clerk waits on one side of the check-out counter. The POS register is often placed on the side of the check-out counter on which side the clerk is waiting so that the clerk can operate the POS register. The customer stands on the other side of the check-out counter and places a product that he/she wants to purchase on the check-out counter. The clerk registers the number and the price of the product placed on the check-out counter in the POS register. The clerk receives money from the customer and inserts that money in the money handling system. The money handling system is explained in detail below.

A configuration of the banknote handling machine 1 is explained in detail below by using FIG. 2. A right side surface of a later-explained housing 1*a* shown in FIG. 2 is a front surface side of the banknote handling machine 1 (that is, a front surface side when the banknote handling machine 1 is seen from a front side shown in FIG. 1). Moreover, a left direction in FIG. 2 is a depth direction of the housing 1*a*.

As shown in FIG. 2, the banknote handling machine 1 includes the housing 1*a* of a substantially rectangular parallelepiped shape. The banknote handling machine 1 includes an upper unit 2 and a lower unit 3. The upper unit 2 includes a banknote inserting unit 10 for inserting a banknote inside the housing 1*a* from the outside thereof, a transport unit 12 for transporting the banknote inserted inside the housing 1*a* by the banknote inserting unit 10, a recognition unit 14 arranged in the transport unit 12 for recognizing the banknote transported by the transport unit 12, and a banknote ejecting unit 16 for ejecting the banknote outside the housing 1*a* from the inside thereof.

The banknote inserting unit 10 includes a plurality of rollers such as feed rollers, kicker rollers, and the like. A bottom-most banknote of the banknotes put by an operator in a stacked manner in the banknote inserting unit 10 is kicked one by one by the kicker roller toward the feed roller. The kicked banknote is fed one by one inside the housing 1*a* by the feed roller. The banknote fed inside the housing 1*a* by the banknote inserting unit 10 is transported one by one by the transport unit 12. The recognition unit 14 recognizes denomination, authenticity, fitness, version, face side up/back side up, transportation state, and the like of the banknote transported by the transport unit 12. The banknote recognized by the recognition unit 14 is sent by the transport unit 12 to one among a plurality of later-explained storing and feeding units 20 based on, for example, the denomination of the banknote.

At diversion point in the transport unit 12 is arranged a diverter 12*e* (see FIG. 5) such as a diverting claw. A transportation destination of the banknote at a given diversion point is decided by the corresponding diverter 12*e*. As shown in FIG. 2, banknote detecting sensors 12*a* are arranged at various locations in the transport unit 12 for detecting the banknote transported by the transport unit 12. Each of the banknote detecting sensors 12*a* is constituted by an optical sensor and the like including a light emitting element and a light receiving element. The banknote is detected by the banknote detecting sensor 12*a* when a light emitted by the light emitting element is not received by the light receiving element as the light is blocked by the banknote transported by the transport unit 12. Detection information of the banknote detected by each of the banknote detecting sensors 12*a* is sent to a later-explained controlling unit 50. Based on the detection result of the banknote obtained in each of the banknote detecting sensors 12*a*, the controlling unit 50 determines whether a distance between the adjacent banknotes transported by the transport unit 12 is equal to a predetermined value. When the controlling unit 50 determines that the distance between adjacent banknotes transported by the transport unit 12 is considerably different from the predetermined value, it is decided that a transportation abnormality such as skew, multifeed, and chaining, has occurred in the banknote transported by the transport unit 12.

In the upper unit 2, two banknote storing units (capture bins) 18 and 19 are connected to the transport unit 12. The banknote transported by the transport unit 12 can be sent to and stored in any of the banknote storing units 18 and 19; however, the banknote stored in the banknote storing unit 18 or 19 cannot be fed to the transport unit 12 from the banknote storing unit 18 or 19. The positions of the banknote storing units 18 and 19 are decided such that it is possible to send the banknote to any of the banknote storing units 18 and 19 from the transport unit 12 when performing any of a money deposition process and a money dispensing process of the banknote. In the present embodiment, at least one between a counterfeit banknote and a suspicious banknote about the authentication is stored in one of the two banknote storing units 18 and 19 (for example, the banknote storing unit 19 that is closer to the banknote ejecting unit 16). In the other banknote storing unit (for example, the banknote storing unit 18 that is away from the banknote ejecting unit 16) is stored a banknote (specifically, for example, a banknote in which a transportation abnormality has occurred) that is fed from any of the later-explained storing and feeding units 20 to the transport unit 12 but that cannot be ejected by the banknote ejecting unit 16 outside of the housing 1*a* when performing the money dispensing process of the banknote.

As shown in FIG. 2, the transport unit 12 spans in both the upper unit 2 and the lower unit 3. In the lower unit 3, a plurality of the storing and feeding units 20 (four in the example shown in the FIG. 2) are connected to the transport unit 12. The storing and feeding units 20 are arranged one above the other along a height direction of the banknote handling machine 1. In the present embodiment, as explained below, each of the storing and feeding units 20 can be removed from the lower unit 3 of the banknote handling machine 1. Each of the storing and feeding units 20 can store therein the banknote sent thereto by the transport unit 12 and each of the storing and feeding units 20 can feed the banknotes one by one stored therein to the transport unit 12. More particularly, among the four storing and feeding units 20, each of the uppermost storing and feeding unit 20 and the bottommost storing and feeding unit 20 includes a banknote storing mechanism 22 having one drum 22*a*. A pair of tapes between which the banknotes sent by the transport unit 12 are sandwiched one after the other is wound on the drum 22*a* along with the banknotes. When the drum 22*a* is rotated in an opposite direction of a winding direction of the tapes, the banknotes sandwiched between the tapes can be fed one by one to the transport unit 12 as the tapes are unwound from the drum 22*a*. A maximum number of banknotes that can be stored in the banknote storing mechanism 22 is, for example, 300. Among the four storing and feeding units 20, each of the second storing and feeding unit 20 from the top and the third storing and feeding unit 20 from the top includes two banknote storing mechanisms 24 and 26 having mutually different maximum storing capacities of the banknotes. The banknote storing mechanisms 24 and 26 respectively includes drums 24*a* and 26*a*. More particularly, in the banknote storing mechanisms 24 and 26, a pair of tapes between which the banknotes sent by the transport unit 12 are sandwiched one after the other is wound on the drums 24*a* and 26*a* along with the banknotes. When the drum 24*a* or 26*a* is rotated in an opposite direction of a winding direction of the tapes, the banknotes sandwiched between the tapes can be fed one by one to the transport unit 12 as the tapes are unwound from the drum 24*a* or 26*a*. A length of the tapes that are wound on the drum 26*a* is longer than a length of the tapes wound on the drum 24*a*. Accordingly, a maximum number of banknotes that can be stored on the drum 26*a* is greater than a maximum number of banknotes that can be stored on the drum 24*a*. Specifically, while a maximum number of banknotes that can be stored in the banknote storing mechanism 24 is 100, and a maximum number of banknotes that can be stored in the banknote storing mechanism 26 is 200. The total of the maximum number of banknotes that can be stored in the banknote storing mechanism 24 and the maximum number of banknotes that can be stored in the banknote storing mechanism 26 is 300. This total is equal to the maximum number of banknotes that can be stored in the banknote storing mechanism 22. A configuration of the storing and feeding unit 20 that includes the two banknote storing mechanisms 24 and 26 is explained in detail later.

A collecting unit 40 is arranged in the lower unit 3, and the collecting unit 40 is connected to the transport unit 12. This collecting unit 40 is used to collect the banknotes stored in the storing and feeding units 20. More specifically, a not-shown banknote storage bag for storing the banknotes is detachably attached in the collecting unit 40. The banknote sent from each of the storing and feeding units 20 to the collecting unit 40 via the transport unit 12 is stored in the banknote storage bag. Moreover, the banknote of a denomination that is not allocated to any of the storing and feeding units 20, or an overflow banknote, which is a banknote that cannot be stored because the storing and feeding unit 20 of a corresponding denomination is full, is stored in the banknote storage bag mounted in the collecting unit 40. The banknotes can be collected together with the banknote storage bag from the banknote handling machine 1 by removing the banknote storage bag from the collecting unit 40. Note that, in the collecting unit 40, the detachably attachable not-shown banknote storage bag for storing the banknotes can be replaced with a detachably attachable banknote collecting cassette for storing the banknotes. In this case, the banknotes sent from the transport unit 12 to the collecting unit 40 are stored in this banknote collecting cassette. Moreover, after the banknotes are stored in the banknote collecting cassette, the banknotes can be collected together with the banknote collecting cassette from the banknote handling machine 1 by removing the banknote collecting cassette from the collecting unit 40.

In the banknote handling machine 1 according to the present embodiment, the lower unit 3 constitutes a safe housing to which only an operator having the predetermined powers and authorities can access. A secure transportation company has the management authority of the banknotes stored in the storing and feeding units 20 and the collecting unit 40 of the lower unit 3. Only a guard of the secure transportation company can open a not-shown door of the lower unit 3 and can access to the inside of the lower unit 3. Specifically, a not-shown locking mechanism is provided that locks the door of the lower unit 3 after the door is closed, and only an operator (for example, the guard of the secure transportation company) who is allowed to access the inside of the lower unit 3 has a key and/or a password to release the lock of the door by the locking mechanism. Accordingly, only the guard of the secure transportation company can collect the banknote storage bag present in the collecting unit 40 from the inside of the lower unit 3. That is, a salesclerk and the like of the shop cannot access to the inside of the lower unit 3 and remove the banknotes stored in any of the storing and feeding units 20 and the collecting unit 40. With this configuration, antithefting of the banknote stored in the storing and feeding units 20 and the collecting unit 40 can be enhanced.

As shown in FIGS. 1 and 2, the banknote ejecting unit 16 is provided with a shutter mechanism 17 for opening/closing a banknote ejection opening provided in the banknote ejecting unit 16. As shown in FIGS. 1 and 2, when the banknote ejection opening provided in the banknote ejecting unit 16 is closed by closing the shutter mechanism 17, the operator cannot remove the banknotes, which are sent to the banknote ejecting unit 16 by the transport unit 12 when the money dispensing process of the banknotes is performed, from the banknote ejecting unit 16 outside of the housing 1*a*. On the other hand, when the banknote ejection opening provided in the banknote ejecting unit 16 is opened by opening the shutter mechanism 17, the operator can remove the banknotes sent to the banknote ejecting unit 16 by the transport unit 12 from the banknote ejecting unit 16 outside of the housing 1*a*. Note that, when the banknote handling machine 1 is in a standby state, the shutter mechanism 17 is in the closed state thereby closing the banknote ejection opening provided in the banknote ejecting unit 16.

Next, a detailed configuration of the coin handling machine 101 is briefly explained below. The coin handling machine 101 includes a housing 101*a* of a substantially rectangular parallelepiped shape, a coin inserting unit 110 for inserting a coin inside the housing 101*a* from the outside thereof, and a coin ejecting unit 172 for ejecting the coin outside of the housing 101*a* from the inside thereof. Moreover, inside the housing 101*a* are arranged a not-shown recognition unit for recognizing the coin inserted in the housing 101*a* by the coin inserting unit 110 and a plurality of not-shown storing and feeding units each of which stores therein the coin recognized by the recognition unit per denomination. The coin fed from any of the storing and feeding units is ejected by the coin ejecting unit 172 outside of the housing 101*a* from the inside thereof. Moreover, inside the housing 101*a* is arranged a not-shown collecting box used as an overflow coin storage section. The collecting box can be pulled horizontally and toward the front side out of a not-shown collecting box accommodating unit provided in a lower part of the housing 101*a*. An overflow coin, which is a coin that could not be stored in any of the storing and feeding units, or a coin that is fed from the storing and feeding unit but that needs to be collected, is stored in the collecting box. After the coins are stored in the collecting box, the guard and the like of the secure transportation company can collect the coins together with the collecting box by pulling the collecting box toward the front side from the collecting box accommodating unit.

A configuration of a control system of the money handling system according to the present embodiment is explained below by using FIG. 3. As shown in FIG. 3, the controlling unit 50 is arranged inside the housing 1*a* of the banknote handling machine 1. Various structural components of the banknote handling machine 1 are controlled by this controlling unit 50. More particularly, the banknote inserting unit 10, the transport unit 12, the banknote detecting sensors 12*a*, the recognition unit 14, the shutter mechanism 17, the storing and feeding units 20, and the like are connected to the controlling unit 50. A signal representing a recognition result of the banknote by the recognition unit 14 and a signal representing a detection result of the banknote by each of the banknote detecting sensors 12*a* are sent to the controlling unit 50. The controlling unit 50 controls various structural components, such as the banknote inserting unit 10, the transport unit 12, the shutter mechanism 17, and the storing and feeding units 20, by sending a command signal to the respective structural component. Moreover, inside the housing 101*a* of the coin handling machine 101 is arranged a controlling unit 180 for controlling various structural components of the coin handling machine 101. The controlling unit 50 arranged inside the housing 1*a* of the banknote handling machine 1 and the controlling unit 180 arranged inside the housing 101*a* of the coin handling machine 101 are connected to each other with a signal line allowing transmission and reception of signals between the controlling unit 50 and the controlling unit 180.

As shown in FIG. 3, an operation/display unit 54, a memory 56, and a communication interface unit 58 are connected to the controlling unit 50. The operation/display unit 54 is constituted by, for example, a touch screen and the like arranged on a front surface or a top surface of the housing 1*a*. On the operation/display unit 54 are displayed a handling state of the banknotes in the banknote handling machine 1 and/or the coins in the coin handling machine 101, and information and the like about an inventory amount per denomination of the banknotes stored in each of the storing and feeding units 20 of the banknote handling machine 1 and/or the coins stored in each of the storing and feeding units of the coin handling machine 101, and the like. The operator can input various commands into the controlling unit 50 of the banknote handling machine 1 and the controlling unit 180 of the coin handling machine 101 by operating the operation/display unit 54. In the memory 56 are stored a handling history of the banknotes handled by the banknote handling machine 1 and/or the coins handled by the coin handling machine 101, and information and the like about an inventory amount per denomination of the banknotes stored in each of the storing and feeding units 20 of the banknote handling machine 1 and/or the coins stored in each of the storing and feeding units of the coin handling machine 101, and the like. The controlling unit 50 can transmit and receive signals via the communication interface unit 58 to and from an external device (specifically, for example, a POS register) provided separately from the banknote handling machine 1 and the coin handling machine 101. Moreover, in the money handling system according to the present embodiment, if it is possible to use a not-shown mobile device such as a mobile telephone, smartphone, and iPad (Registered Trademark), the controlling unit 50 transmits and receives signals via the communication interface unit 58 to this mobile device.

A detailed configuration of the storing and feeding unit 20 that includes the two banknote storing mechanisms 24 and 26 (that is, the second storing and feeding unit 20 from the top and the third storing and feeding unit 20 from the top among the four storing and feeding units 20 shown in FIG. 2) is explained below by using FIG. 4 to FIG. 8D.

The second storing and feeding unit 20 from the top and the third storing and feeding unit 20 from the top among the four storing and feeding units 20 of the banknote handling machine 1 shown in FIG. 2 has a casing 20*a* of a substantially rectangular parallelepiped shape and the two banknote storing mechanisms 24 and 26 arranged inside the casing 20*a*. The banknote storing mechanisms 24 and 26 are aligned along a depth direction (specifically, the right direction in FIG. 4) of the casing 20*a*. Each of the banknote storing mechanisms 24 and 26 can store therein the banknote sent inside the casing 20*a* from the outside thereof (specifically, the banknote sent by the transport unit 12), and each of the banknote storing mechanisms 24 and 26 can feed the banknote stored therein to the transport unit 12. When a surface of the casing 20*a* of the substantially rectangular parallelepiped shape having the largest surface area is assumed as a rectangle, the depth direction of the casing 20*a* can be defined as a direction parallel to the long sides of the rectangle. Alternatively, when a surface on which an insertion inlet 24*b* for sending the banknote inside the casing 20*a* from the outside thereof has been formed is assumed as a front surface and a surface opposite to this front surface is assumed as a back surface, the depth direction of the casing 20*a* can be defined as a direction from the front surface to the back surface. Alternatively, when the casing 20*a* is assumed to have a laterally-extending substantially rectangular parallelepiped shape as shown in FIG. 4, the depth direction of the casing 20*a* can be defined as the lateral direction. Alternatively, the further inside in the depth direction of the casing 20*a* can be defined as a downstream side of a direction in which the banknote is sent inside the casing 20*a*. A banknote transport mechanism 32 that sends the banknote from an insertion inlet 26*b* to the banknote storing mechanism 26 is arranged inside the casing 20*a* but below the banknote storing mechanism 24. In this structure, it can be defined that, the front side in the depth direction is a side in which the insertion inlet 26*b* has been arranged, and the further inside in the depth direction is a downstream side toward which the banknote sent in from the insertion inlet 26*b* is transported by the banknote transport mechanism 32. More specifically, it can be defined that, the front side in the depth direction is the left side in FIG. 4 and the further inside in the depth direction is the right side in FIG. 4. Note that, the casing 20*a* is not limited to an integrated housing structure. That is, the casing 20*a* can be constituted by assembling a plurality of parts. Moreover, the casing 20*a* can have a cubic shape. The storing and feeding unit 20 can be constituted by assembling a plurality of separate units. In this structure, it is sufficient that the overall external appearance of the storing and feeding unit 20 has a substantially rectangular parallelepiped shape. In brief, the casing 20*a* is an outer cover of the storing and feeding unit 20, and it can be one structural component itself, can be combined with other structural component, or can be constituted as an assembly of a plurality of structural components.

The banknote storing mechanism 24 present in the front side in the depth direction of the casing 20*a*, as shown in FIG. 4 and the like, includes the drum 24*a* (rotating member) that rotates around an axis arranged orthogonal to the depth direction of the casing 20*a*, a pair of belt-shaped tapes 30*a* and 30*b* (winding member) with one end thereof connected to a predetermined place (for example, an outer peripheral surface or the axis) of the drum 24*a*, a reel 25*a* (winding member accommodating unit) to which the other end of one of the tapes 30*a* is connected and that can accommodate the tape 30*a*, and a reel 25*b* (winding member accommodating unit) to which the other end of the other tape 30*b* is connected and that can accommodate the tape 30*b*. The banknote storing mechanism 24 is provided with a motor 28 (driving unit) for rotationally driving at least one of the drum 24*a* and the reels 25*a* and 25*b*. Specifically, the motor 28 can cause a not-shown endless belt to perform a circulating movement in a forward direction and a reverse direction. A pulley is arranged on each of the axis of the drum 24*a* and axes of the reels 25*a* and 25*b*, and the endless belt is looped over these pulleys. Accordingly, the drum 24*a* and the reels 25*a* and 25*b* can be rotated in a winding direction of the banknotes on the drum 24*a* and an unwinding direction of the banknotes from the drum 24*a*. Moreover, the insertion inlet 24*b* is provided in a side surface (specifically, a side surface on the left side in FIG. 4) in the front side in the depth direction of the casing 20*a*. The banknotes sent to the banknote storing mechanism 24 by the transport unit 12 and the banknotes fed from the banknote storing mechanism 24 and sent to the transport unit 12 pass through this insertion inlet 24*b*. As shown in FIG. 5, the banknote storing mechanism 24 is provided with a pressing member 24*c* for pressing down the banknotes wound on the drum 24*a* between the tapes 30*a* and 30*b*. The pressing member 24*c* is pivotable around an axis 24*d* provided at an end portion thereof. Moreover, the axis 24*d* is provided with a torsion spring for pushing the pressing member 24*c* toward the drum 24*a*. Because of this torsion spring, irrespective of whether the number of the banknotes wound on the drum 24*a* is large or small, the pressing member 24*c* always pushes the banknotes wound on the drum 24*a* towards a center of the drum 24*a*.

In the banknote storing mechanism 24 having the above configuration, banknotes can be stored one after the other on the drum 24*a* when the tapes 30*a* and 30*b* are wound on the drum 24*a* while the banknotes have been sandwiched between the tapes 30*a* and 30*b*, and the banknotes can be fed one after the other from the drum 24*a* by unwinding the tapes 30*a* and 30*b* from the drum 24*a*. In the present embodiment, the banknotes inserted by the transport unit 12 inside the casing 20*a* through the insertion inlet 24*b* are sandwiched between the tapes 30*a* and 30*b*, and the tapes 30*a* and 30*b* with the banknotes sandwiched therebetween are wound on the drum 24*a*. Moreover, by unwinding the tapes 30*a* and 30*b* from the drum 24*a*, the banknotes fed from the drum 24*a* can be sent to the transport unit 12 through the insertion inlet 24*b*.

The banknote storing mechanism 26 present further inside in the depth direction of the casing 20*a*, as shown in FIG. 4 and the like, includes the drum 26*a* (rotating member) that rotates around an axis arranged orthogonal to the depth direction of the casing 20*a*, a pair of belt-shaped tapes 31*a* and 31*b* (winding member) with one end thereof connected to a predetermined place (for example, an outer peripheral surface or the axis) of the drum 26*a*, a reel 27*a* (winding member accommodating unit) to which the other end of one of the tapes 31*a* is connected and that can accommodate the tape 31*a*, and a reel 27*b* (winding member accommodating unit) to which the other end of the other tape 31*b* is connected and that can accommodate the tape 31*b*. The banknote storing mechanism 26 is provided with a motor 29 (driving unit) for rotationally driving at least one of the drum 26*a* and the reels 27*a* and 27*b*. Specifically, the motor 29 can cause a not-shown endless belt to perform a circulating movement in a forward direction and a reverse direction. A pulley is arranged on each of the axis of the drum 26*a* and axes of the reels 27*a* and 27*b*, and the endless belt is looped over these pulleys. Accordingly, the drum 26*a* and the reels 27*a* and 27*b* can be rotated in a winding direction of the banknote on the drum 26*a* and an unwinding direction of the banknotes from the drum 26*a*. Moreover, the insertion inlet 26*b* is provided in the side surface (specifically, the side surface on the left side in FIG. 4) in the front side in the depth direction of the casing 20*a*. The banknotes sent to the banknote storing mechanism 26 by the transport unit 12 and the banknotes fed from the banknote storing mechanism 26 and sent to the transport unit 12 pass through this insertion inlet 26*b*. The insertion inlet 26*b* is provided below the insertion inlet 24*b* in a height direction of the casing 20*a*. As shown in FIG. 5, the banknote storing mechanism 26 is provided with a pressing member 26*c* for pressing down the banknotes wound on the drum 26*a* between the tapes 31*a* and 31*b*. The pressing member 26*c* is pivotable around an axis 26*d* provided at an end portion thereof. Moreover, the axis 26*d* is provided with a torsion spring for pushing the pressing member 26*c* toward the drum 26*a*. Because of this torsion spring, irrespective of whether the number of the banknotes wound on the drum 26*a* is large or small, the pressing member 26*c* always pushes the banknotes wound on the drum 26*a* towards a center of the drum 26*a*.

As shown in FIG. 4 and the like, the banknote transport mechanism 32 for sending the banknotes from the insertion inlet 26*b* to the banknote storing mechanism 26 and for sending the banknotes fed by the banknote storing mechanism 26 to the insertion inlet 26*b* is arranged in a region below the banknote storing mechanism 24 in the casing 20*a*. In the present embodiment, the banknotes inserted by the transport unit 12 inside the casing 20*a* through the insertion inlet 26*b* are sent to the banknote storing mechanism 26 by the banknote transport mechanism 32, the banknotes sent to the banknote storing mechanism 26 are sandwiched between the tapes 31*a* and 31*b*, and the tapes 31*a* and 31*b* with the banknotes sandwiched therebetween are wound on the drum 26*a*. Moreover, by unwinding the tapes 31*a* and 31*b* from the drum 26*a*, the banknotes fed from the drum 26*a* are sent by the banknote transport mechanism 32 to the insertion inlet 26*b*, and the banknotes are sent to the transport unit 12 through the insertion inlet 26*b*.

In the present embodiment, as shown in FIG. 4, the banknote transport mechanism 32 includes a pair of top and bottom endless belts 32*a*, and each of the endless belts 32*a* is looped over a plurality of pulleys 32*b*. In the banknote transport mechanism 32 having such a configuration, the banknotes are transported between the insertion inlet 26*b* and the banknote storing mechanism 26 when the endless belts 32*a* are caused to make a circulating movement with the banknotes sandwiched between the endless belts 32*a*. Moreover, as shown in FIG. 7, a gear 32*c* is coaxially fixed to one of the pulleys 32*b* (specifically, the pulley 32*b* located in the most front side in the depth direction of the storing and feeding unit 20) among the pulleys 32*b* on which the endless belts 32*a* are looped. The pulley 32*b* and the gear 32*c* rotate synchronously around one shaft as a center. As shown in FIG. 7, the transport unit 12 includes an endless belt 12*b* for transporting the banknote in the vertical direction inside the lower unit 3. This endless belt 12*b* is looped over a plurality of pulleys 12*c*. Moreover, a gear 12*d* is coaxially fixed to one of the pulleys 12*c*, which opposes the pulley 32*b* in the banknote transport mechanism 32 of the storing and feeding unit 20, among the pulleys 12*c* on which the endless belt 12*b* is looped. The pulley 12*c* and the gear 12*d* rotate synchronously around one shaft as a center. As shown in FIG. 7, the gear 32*c* and the gear 12*d* are engaged with each other so that the gear 32*c* rotates when the gear 12*d* rotates. With such a configuration, even if a driving source of the endless belts 32*a* in the banknote transport mechanism 32 is not arranged inside the storing and feeding unit 20, because a driving force of the endless belt 12*b* in the transport unit 12 can be conveyed to the banknote transport mechanism 32 via the gears 12*d* and 32*c*, each of the endless belts 32*a* can be caused to perform the circulating movement. Moreover, even if the driving source of the endless belts 32*a* is not arranged inside the casing 20*a* of the storing and feeding unit 20, a driving force of the endless belts 32*a* can be obtained from the outside of the storing and feeding unit 20.

A unit configuration of the storing and feeding unit 20 including the two banknote storing mechanisms 24 and 26 is explained below by using FIG. 6. As shown in FIG. 6, the storing and feeding unit 20 can have a structure that can be divided into a plurality of units. More particularly, the storing and feeding unit 20 has a first side wall 33 that is arranged on a side of the banknote storing mechanism 24, and a second side wall 34 that is arranged on sides of both the banknote storing mechanism 26 and the banknote transport mechanism 32. The first side wall 33 and the second side wall 34 are separable from each other. Moreover, the drum 24*a*, the reels 25*a* and 25*b*, and the motor 28 of the banknote storing mechanism 24 are fixed to the first side wall 33 and constitute a first unit, and the banknote transport mechanism 32 and the drum 26*a*, the reels 27*a* and 27*b*, and the motor 29 of the banknote storing mechanism 26 are fixed to the second side wall 34 and constitute a second unit. Because the banknote storing mechanism 24 included in the first unit is driven by the motor 28 and the banknote storing mechanism 26 included in the second unit is driven by the motor 29, the first unit and the second unit are driven independently from each other. Moreover, the first unit and the second unit always receive or deliver the banknote via the transport unit 12. Accordingly, the first unit including the banknote storing mechanism 24 and the second unit including the banknote storing mechanism 26 can be separated from each other. Moreover, when one between the first unit and the second unit fails or becomes needless, only one between them can be connected to the transport unit 12 to continue the use. Note that, as another embodiment of the storing and feeding unit 20, a structure is allowable in which the second unit is further divided into a third unit including the banknote storing mechanism 26 and a fourth unit including the banknote transport mechanism 32. Because the banknote storing mechanism 24 included in the third unit is driven by the motor 29 and the banknote transport mechanism 32 included in the fourth unit is driven by the driving force of the transport unit 12, the third unit and the fourth unit are driven independently from each other. Accordingly, for example, another unit varying in the maximum storable banknote number can be used as the third unit. Moreover, an opening 34*a* is arranged on a side of the banknote transport mechanism 32 in the second side wall 34. The operator can see the endless belts 32*a* of the banknote transport mechanism 32 through this opening 34*a*. Accordingly, when a trouble such as jamming of the banknote occurs in the endless belts 32*a* of the banknote transport mechanism 32, the operator can immediately check the banknote jammed in the endless belts 32*a* through the opening 34*a*. Moreover, in a structure in which the storing and feeding unit 20 can be divided in a plurality of units, an outer cover of the storing and feeding unit 20 with the assembled units constitutes the casing 20*a*.

As shown in FIG. 6, an opening and shutting guide 36 is arranged in a bottom part of the banknote storing mechanism 26 side in the banknote transport mechanism 32. The opening and shutting guide 36 is rotatable around an axis 36*a* in a direction shown with an arrow in FIG. 6. Ordinarily, the opening and shutting guide 36 is positioned at a position shown with a solid line in FIG. 6. However, when a trouble such as jamming of the banknote occurs at an entrance point where the tapes 31*a* and 31*b* overlap in the banknote storing mechanism 26, the opening and shutting guide 36 is moved to a position shown with a two-dot chain line in FIG. 6 thereby opening the bottom part of the banknote transport mechanism 32. By providing such an opening and shutting guide 36, even when jamming of the banknote occurs at the entrance point of the banknote storing mechanism 26 as the banknote sent to the banknote storing mechanism 26 by the banknote transport mechanism 32 is not sandwiched between the tapes 31*a* and 31*b* when storing the banknote in the banknote storing mechanism 26, or jamming of the banknote occurs between the banknote storing mechanism 26 and the banknote transport mechanism 32 as the banknote released from between the tapes 31*a* and 31*b* is not sandwiched between the endless belts 32*a* of the banknote transport mechanism 32 when feeding the banknote from the banknote storing mechanism 26 and sending the banknote to the banknote transport mechanism 32, the operator can remove the jammed banknote after opening the opening and shutting guide 36. Note that, in the banknote storing mechanism 24, because the point where the banknote is sandwiched between the tapes 30*a* and 30*b* is close to the insertion inlet 24*b*, when a trouble such as the jamming of the banknote occurs at the point where the tapes 30*a* and 30*b* overlap at the time of storing the banknote in the banknote storing mechanism 24 and/or feeding the banknote from the banknote storing mechanism 24, the operator can remove the jammed banknote through the insertion inlet 24*b*.

Figure 8A:
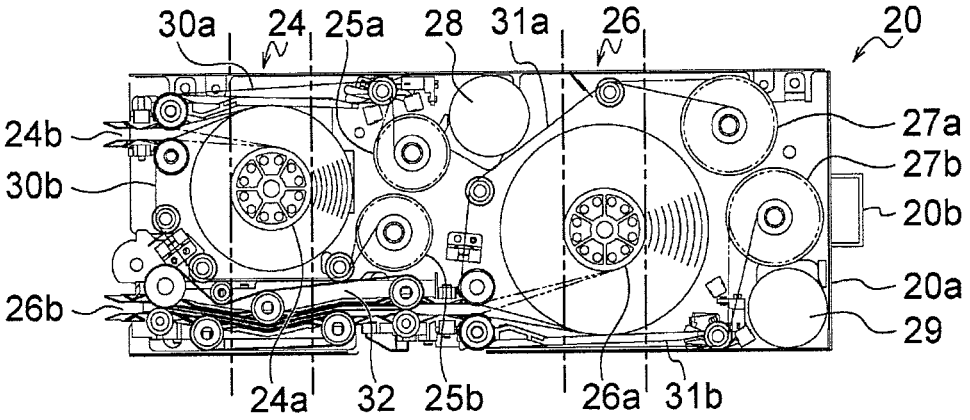

In the present embodiment, as shown with a two-dot chain line in FIG. 8A, at least one of the drums 24*a* and 26*a* is arranged at a position at which the drum does not overlap with any of the reels 25*a*, 25*b*, 27*a*, and 27*b* when viewed in a predetermined direction. The predetermined direction (that is, the up-down direction in FIG. 4 and FIG. 8A) is orthogonal to the depth direction of the casing 20*a* and also orthogonal to an axis direction of the drums 24*a* and 26*a*. The casing 20*a* has a substantially rectangular parallelepiped shape, and a side surface of the substantially rectangular parallelepiped shape having the largest surface area is a rectangle. The direction of the long sides of the rectangle is the depth direction of the casing, and the drums 24*a* and 26*a* are arranged side by side along the depth direction of the casing. In this configuration, the predetermined direction is a direction along a surface that is orthogonal to the axis direction of the drums 24*a* and 26*a* (that is, the surface of the paper sheet on which FIG. 4 has been printed), and is a direction along a surface that is orthogonal to the long sides of the side surface of the substantially rectangular parallelepiped shaped casing 20*a* having the largest surface area. Note that, in the storing and feeding unit 20 having the configuration shown in FIG. 4, both the drums 24*a* and 26*a* are arranged at the positions at which the drums do not overlap with any of the reels 25*a*, 25*b*, 27*a*, and 27*b* in the predetermined direction. Moreover, in the present embodiment, at least one of the drums 24*a* and 26*a* is arranged at a position at which the drum does not overlap with any of the motors 28 and 29 in the predetermined direction. Note that, in the storing and feeding unit 20 having the configuration shown in FIG. 4, both the drums 24*a* and 26*a* are arranged at the positions at which the drums do not overlap with any of the motors 28 and 29 in the predetermined direction. Because the drums 24*a* and 26*a* are arranged at the positions at which the drums do not overlap with any of the reels 25*a*, 25*b*, 27*a*, and 27*b* and any of the motors 28 and 29 in the predetermined direction, even if the length of the casing 20*a* in the predetermined direction is previously fixed, a diameter of an outer peripheral edge of the outermost tapes 30*a*, 30*b*, 31*a*, and 31*b* wound on the drums 24*a* and 26*a* when the banknotes of the maximum storable number are stored therein can be made relatively large. Therefore, in the present embodiment, in comparison to a case in which each of the drums 24*a* and 26*a* overlaps at least partially with at least one of the reels 25*a*, 25*b*, 27*a*, and 27*b* and the motors 28 and 29 in the predetermined direction, the maximum storable banknote number in each of the banknote storing mechanisms 24 and 26 can be increased. Note that, the outer peripheral edge of any of the tapes 30*a*, 30*b*, 31*a*, and 31*b* wound on any of the drums 24*a* and 26*a* when the banknotes of the maximum storable number are stored therein is an outer peripheral edge of a circle defined by the outermost turn of any of the tapes 30*a*, 30*b*, 31*a*, and 31*b* when the banknotes of the maximum storable number are wound on any of the drums 24*a* and 26*a* in a substantially concentric manner.

Figure 8B:
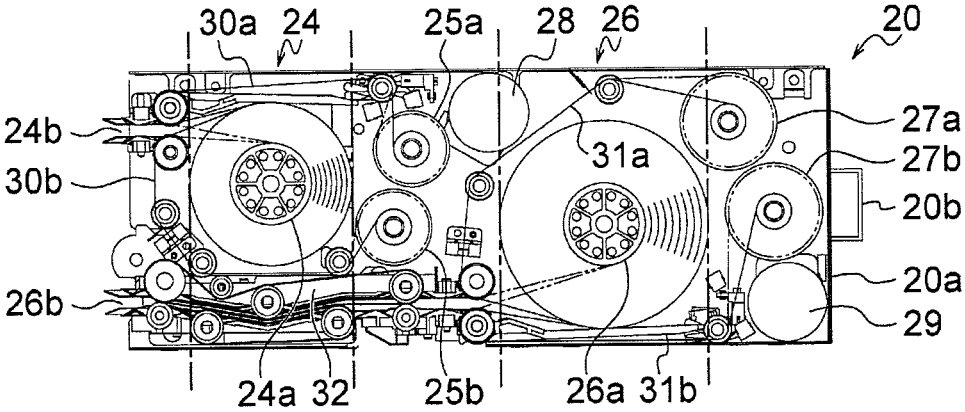

In the present embodiment, as shown with a two-dot chain line in FIG. 8B, the outer peripheral edge of any of the tapes 30*a* and 30*b* wound on the drum 24*a* when the banknotes of the maximum storable number are stored in the banknote storing mechanism 24 does not overlap with any of the reels 25*a* and 25*b* and the motor 28 in the predetermined direction. Moreover, the outer peripheral edge of any of the tapes 31*a* and 31*b* wound on the drum 26*a* when the banknotes of the maximum storable number are stored in the banknote storing mechanism 26 does not overlap with any of the reels 27*a* and 27*b* and the motor 29 in the predetermined direction. With this configuration, the maximum storable banknote number in the banknote storing mechanisms 24 and 26 can be increased. In the storing and feeding unit 20 having the configuration shown in FIG. 4, the outer peripheral edge of any of the tapes 31*a* and 31*b* wound on the drum 26*a* when the banknotes of the maximum storable number are stored in the banknote storing mechanism 26 is overlapping with the motor 28 of the banknote storing mechanism 24 in the predetermined direction; however, the configuration is not limited to this configuration. In a storing and feeding unit according to a variation, it is possible to adopt a configuration such that in all banknote storing mechanism an outer peripheral edge of a tape wound on a drum when banknotes of the maximum storable number are stored therein does not overlap with any of reels and motors in a predetermined direction.

Figure 8C:
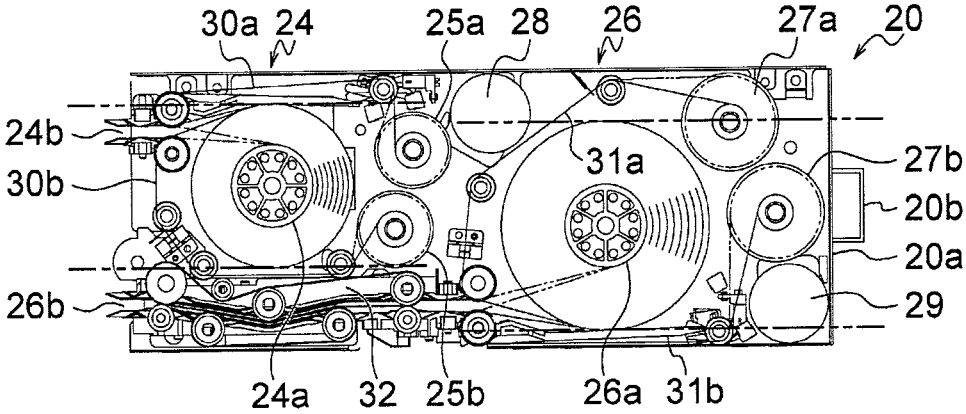

In the present embodiment, as shown with a two-dot chain line in FIG. 8C, the outer peripheral edge of any of the tapes 30*a*, 30*b*, 31*a*, and 31*b* wound on any of the drums 24*a* and 26*a* when the banknotes of the maximum storable number are stored in any of the banknote storing mechanisms 24 and 26 overlaps at least partially with at least one of the reels 25*a*, 25*b*, 27*a*, and 27*b* and the motors 28 and 29 in the depth direction of the casing 20*a* (that is, the left-right direction in FIG. 4 and FIG. 8C). In this configuration, in the banknote storing mechanisms 24 and 26, because the drums 24*a* and 26*a*, the reels 25*a*, 25*b*, 27*a*, and 27*b*, and the motors 28 and 29 are arranged side by side along the depth direction of the casing 20*a*, a dead space inside the casing 20*a* is reduced, the space inside the casing 20*a* can be used effectively, and the length in the predetermined direction of the casing 20*a* can be reduced.

In the present embodiment, in at least one of the banknote storing mechanisms 24 and 26, any of the reels 25*a* and 25*b*, and the reels 27*a* and 27*b* are arranged further inside in the depth direction of the casing 20*a* than the corresponding drum 24*a* and 26*a*. Note that, in the storing and feeding unit 20 having the configuration shown in FIG. 4, in both the banknote storing mechanisms 24 and 26, the reels 25*a*, 25*b*, 27*a*, and 27*b* are arranged further inside in the depth direction of the casing 20*a* than the corresponding drums 24*a* and 26*a*. Moreover, in the present embodiment, in at least one of the banknote storing mechanisms 24 and 26, any of the motors 28 and 29 is arranged further inside in the depth direction of the casing 20*a* than the corresponding drum 24*a* and 26*a*. Note that, in the storing and feeding unit 20 having the configuration shown in FIG. 4, in both the banknote storing mechanisms 24 and 26, the motors 28 and 29 are arranged further inside in the depth direction of the casing 20*a* than the corresponding drums 24*a* and 26*a*. In this arrangement, in at least the banknote storing mechanism 24 on the front side in the depth direction of the casing 20*a*, a distance between the drum 24*a* and the insertion inlet 24*b* can be reduced. Accordingly, occurrence of the trouble such as jamming of the banknote before the banknote is wound on the drum 24*a* and/or jamming of the banknote fed by the drum 24*a* can be prevented.

Figure 8D:
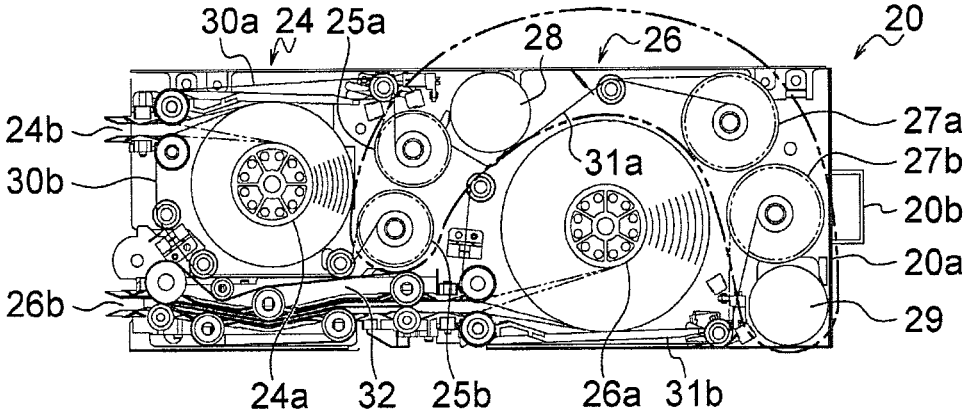

In the present embodiment, as shown with a two-dot chain line in FIG. 8D, all the reels 25*a*, 25*b*, 27*a*, and 27*b* are arranged around the drum 26*a* located further inside in the depth direction of the casing 20*a* among the drums 24*a* and 26*a*. Moreover, both the motors 28 and 29 are arranged around the drum 26*a* located further inside in the depth direction of the casing 20*a* among the drums 24*a* and 26*a*. Accordingly, because the reels 25*a*, 25*b*, 27*a*, and 27*b* and the motors 28 and 29 are arranged further inside in the depth direction of the casing 20*a*, a center of gravity of the storing and feeding unit 20 having the two banknote storing mechanisms 24 and 26 will be located further inside in the depth direction of the casing 20*a*. When carrying the storing and feeding unit 20, the operator grips with his hand a handle 20*b* provided on a side surface that is further inside in the depth direction of the casing 20*a* (specifically, the side surface on the right side in FIG. 4) to remove the storing and feeding unit 20 from the lower unit 3 of the banknote handling machine 1 or accommodate the storing and feeding unit 20 in the lower unit 3. Because the center of gravity of the storing and feeding unit 20 having the two banknote storing mechanisms 24 and 26 is near the handle 20*b*, the work load on the operator in carrying the storing and feeding unit 20 by gripping the handle 20*b* can be reduced. Moreover, the work load on the operator when removing the storing and feeding unit 20 from the lower unit 3 of the banknote handling machine 1 or accommodating the storing and feeding unit 20 in the lower unit 3 can be reduced.

In the present embodiment, when two banknote storing mechanisms 24 and 26 are arranged inside the casing 20*a*, a ratio of a length "n" of a long side to a length "m" of a short side of a side surface of the casing 20*a* along the surface that is orthogonal to the axis direction of the drums 24*a* and 26*a* (that is, the surface of the paper sheet on which FIG. 4 has been printed), is between 2 and 3. When the length of the casing 20*a* in the predetermined direction (that is, the up-down direction in FIG. 4 and FIG. 8A) is previously fixed, the diameter of the outer peripheral edge of the outermost turn of the tapes 30*a*, 30*b*, 31*a*, and 31*b* wound on the drums 24*a* and 26*a* when the banknotes of the maximum storable number are stored therein can be made relatively large. Moreover, it can be prevented that the length in the depth direction of the casing 20*a* becomes too long to accommodate the drums 24*a* and 26*a*, the reels 25*a*, 25*b*, 27*a*, and 27*b*, and the motors 28 and 29 inside the casing 20*a*.

In the present embodiment, the storing and feeding unit 20 having the two banknote storing mechanisms 24 and 26 constitutes a banknote storing device that can store the banknotes and feed the stored banknotes.

An operation of the money handling system according to the present embodiment is explained below. Specifically, operations relating to the money deposition process, the money dispensing process, and a collection process of the banknote in the banknote handling machine 1 are explained below. Note that, the operation of the banknote handling machine 1 explained below is performed by the controlling unit 50 by controlling the various structural components of the banknote handling machine 1.

At first, the operation relating to the money deposition process of the banknote in the banknote handling machine 1 is explained below. When the operator inputs a command to start the money deposition process of the banknote by operating the operation/display unit 54 and inserts the banknotes in the banknote inserting unit 10, the banknotes inserted in the banknote inserting unit 10 are fed one by one inside the housing 1*a* by the plurality of rollers such as the feed rollers and the kicker rollers arranged in the banknote inserting unit 10, and the fed banknotes are transported by the transport unit 12. Moreover, the recognition unit 14 performs various recognition such as denomination, authenticity, fitness, version, face side up/back side up, and transportation state of the banknotes transported by the transport unit 12. A banknote judged to be a normal banknote based on a recognition result obtained in the recognition unit 14 is delivered from the upper unit 2 to the lower unit 3 by the transport unit 12, and such banknotes are stored in the storing and feeding units 20 provided inside the lower unit 3 depending on the denominations of the banknotes. On the other hand, a banknote whose denomination could not be recognized by the recognition unit 14 is sent to the banknote ejecting unit 16, and such banknotes are stacked in the banknote ejecting unit 16. Moreover, a banknote whose denomination is recognized by the recognition unit 14 but the banknote is recognized as being a counterfeit banknote or a suspicious banknote about the authentication by the recognition unit 14 is sent to the banknote storing unit 19 by the transport unit 12, and such banknotes are stored in the banknote storing unit 19. Thus, both the banknote that is recognized as being the counterfeit banknote by the recognition unit 14 and the banknote that is recognized as being the suspicious banknote about the authentication by the recognition unit 14 are stored in the banknote storing unit 19. Moreover, a banknote of a denomination that is not allocated to any one of the storing and feeding units 20, and/or an overflow banknote, which is a banknote that cannot be stored because the storing and feeding unit 20 of a corresponding denomination is full, is sent to the collecting unit 40 by the transport unit 12, and such banknotes are stored in the banknote storage bag mounted in the collecting unit 40. Then, when all the banknotes are fed from the banknote inserting unit 10 to the inside of the housing 1*a* and sent to any one of the storing and feeding units 20, the banknote storing unit 19, and the collecting unit 40, the money deposition process of the banknote in the banknote handling machine 1 is completed.

Then, the operation relating to the money dispensing process of the banknote in the banknote handling machine 1 is explained below. When the operator inputs the number per denomination of the banknotes to be dispensed, the total amount to be dispensed, and the like and inputs a command to start the money dispensing process of the banknote by operating the operation/display unit 54, the banknotes to be dispensed are fed one by one from the corresponding storing and feeding unit 20 to the transport unit 12, and the banknotes are delivered from the lower unit 3 to the upper unit 2 by the transport unit 12. Then, a banknote judged not to have the transportation abnormality based on detection results obtained in the banknote detecting sensors 12*a* is sent to the banknote ejecting unit 16, and such banknotes are stacked in the banknote ejecting unit 16. A banknote judged to have the transportation abnormality based on the detection results obtained in the banknote detecting sensors 12*a* (that is, dispensing reject banknote) is sent to the banknote storing unit 18, and such banknotes are stored in the banknote storing unit 18. Then, when all the banknotes that should be dispensed are sent to the banknote ejecting unit 16 and stacked in the banknote ejecting unit 16, the operator opens the banknote ejection opening of the banknote ejecting unit 16 by opening the shutter mechanism 17 and removes the banknotes from the banknote ejecting unit 16 outside of the housing 1*a*. Then, when the banknotes are removed from the banknote ejecting unit 16 outside of the housing 1*a*, the banknote ejection opening in the banknote ejecting unit 16 is closed again by closing the shutter mechanism 17. In this manner, the money dispensing process of the banknote in the banknote handling machine 1 is completed.

Then, the operation relating to the collection process of the banknote in the banknote handling machine 1 is explained below. When the guard and the like of the secure transportation company inputs a command to start the collection process of the banknote by operating the operation/display unit 54, all the banknotes stored in the storing and feeding units 20 are fed one by one from the storing and feeding unit 20 to the transport unit 12, and the banknotes are sent to the collecting unit 40 by the transport unit 12. Specifically, a not-shown banknote storage bag for storing the banknotes is detachably attached in the collecting unit 40, and the banknotes sent by the transport unit 12 from the storing and feeding units 20 to the collecting unit 40 are stored in the banknote storage bag. Then, when all the banknotes are sent from the storing and feeding unit 20 to the collecting unit 40 and stored in the banknote storage bag mounted in the collecting unit 40, the guard and the like of the secure transportation company opens the door of the lower unit 3 and removes the banknote storage bag from the collecting unit 40 thereby collecting the banknotes together with the banknote storage bag from the banknote handling machine 1. In this manner, when the banknote storage bag in which the banknotes have been stored is removed from the banknote handling machine 1, the collection process of the banknote in the banknote handling machine 1 is completed. Note that, it is not necessary to collect all the banknotes stored in all the storing and feeding units 20 in the collection process. That is, it is allowable to collect only a predetermined number of banknotes or banknotes of a predetermined amount input from the operation/display unit 54.

In the banknote handling machine 1 according to the present embodiment, one denomination can be assigned to each of the banknote storing mechanisms 22, 24, and 26 (specifically, each of the drums 22*a*, 24*a*, and 26*a*) in the four storing and feeding units 20. When doing so, mutually different denominations can be assigned to each of the banknote storing mechanisms 22, 24, and 26, or the same denomination can be assigned to at least two of the banknote storing mechanisms 22, 24, and 26. Furthermore, in a banknote handling machine 1 having a device configuration in which the number of the banknote storing mechanisms 22, 24, and 26 is maximum, a setting to previously assign a denomination to each of the banknote storing mechanisms 22, 24, and 26 can be made. When one or more of the banknote storing mechanisms 22, 24, and 26 fails, or the number of units of the banknote storing mechanisms 22, 24, and 26 changes, the denomination set previously is continued. Such an embodiment is explained by using FIGS. 9A to 9D. The banknote handling machine 1 shown in FIG. 9A, having a device configuration in which the number of the banknote storing mechanisms 22, 24, and 26 is maximum, has the device configuration in which the first storing and feeding unit 20 from the top includes one banknote storing mechanism 22, the second storing and feeding unit 20 from the top includes two banknote storing mechanisms 24 and 26, the third storing and feeding unit 20 from the top includes two banknote storing mechanisms 24 and 26, and the fourth storing and feeding unit 20 from the top includes one banknote storing mechanism 22 thus including six banknote storing mechanisms 22, 24 and 26 in total. In this configuration, the controlling unit 50 assigns each of denominations a, b, c, d, e, and f to each of the six banknote storing mechanisms 22, 24, and 26 having the maximum configuration, and this relation among the banknote storing mechanisms 22, 24, and 26 and the denominations is stored in the memory 56. For example, 10 Euro is assigned as the denomination "a" to the banknote storing mechanism 22 of the first storing and feeding unit 20 from the top among the four storing and feeding units 20, 5 Euro is assigned as the denomination "b" to the banknote storing mechanism 24 and 50 Euro is assigned as the denomination "c" to the banknote storing mechanism 26 of the second storing and feeding unit 20 from the top, 100 Euro is assigned as the denomination "d" to the banknote storing mechanism 24 and 200 Euro is assigned as the denomination "e" to the banknote storing mechanism 26 of the third storing and feeding unit 20 from the top, and 20 Euro is assigned as the denomination "f" to the banknote storing mechanism 22 of the fourth storing and feeding unit 20 from the top.

Figure 9A:
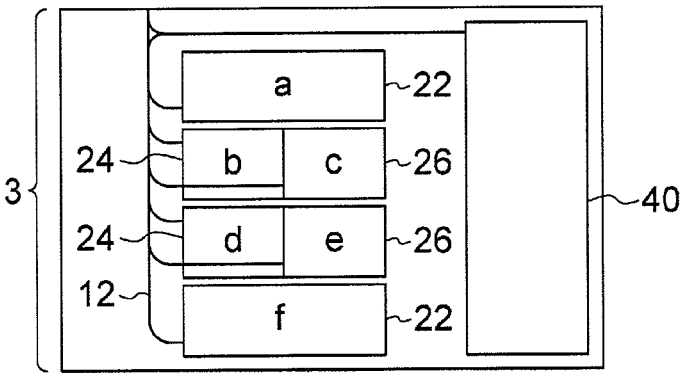
FIG. 9A is a view indicating a banknote denomination and the like linked with a banknote storing mechanism of each of the storing and feeding units in the banknote handling machine of the money handling system shown in FIG. 1.
Figure 9B:
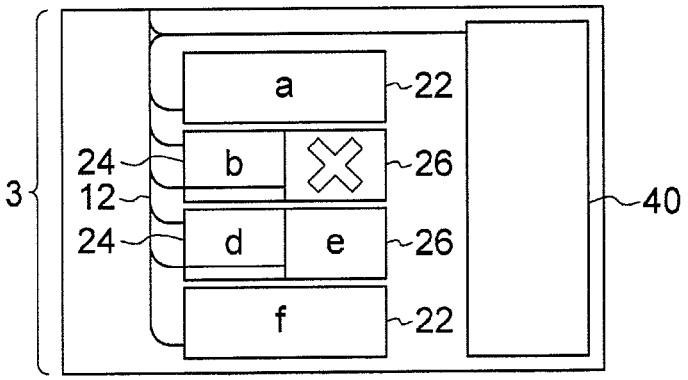
FIG. 9B is a view indicating the banknote denomination and the like linked with the banknote storing mechanism of each of the storing and feeding units in the banknote handling machine of the money handling system shown in FIG. 1.

As shown in FIG. 9A, when one denomination is assigned to each of the banknote storing mechanisms 22, 24, and 26 in the four storing and feeding units 20, and, for example, when a trouble such as jamming of the banknote occurs in the banknote storing mechanism 26 of the second storing and feeding unit 20 from the top whereby this banknote storing mechanism 26 cannot be used, storing of the banknotes in and feeding of the banknotes from cannot be performed in this banknote storing mechanism 26 of the second storing and feeding unit 20 from the top. When this happens, the denomination assigned to each of the banknote storing mechanisms 22, 24, and 26 of the other storing and feeding unit 20 are continued with the previously assigned denomination, and the operation of storing and feeding of the banknotes is continued (see FIG. 9B). In this case, for example, when a denomination of the banknote recognized by the recognition unit 14 while the money deposition process of the banknote is being performed is the denomination assigned to the banknote storing mechanism 26 that is out of service (that is, 50 Euro), such a banknote is sent to the collecting unit 40 and stored in the banknote storage bag. In this manner, it is possible to realize limited operation in the banknote handling machine 1 according to the present embodiment in which use of the banknote storing mechanism other than the banknote storing mechanism that is out of service among the banknote storing mechanisms 22, 24, and 26 in the storing and feeding units 20 can be continued.

Figure 9C:
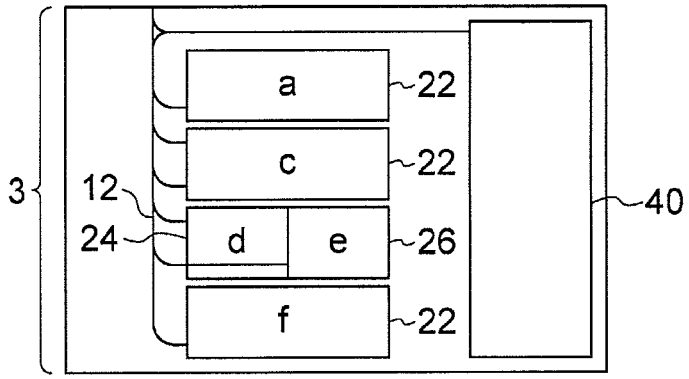
FIG. 9C is a view indicating the banknote denomination and the like linked with the banknote storing mechanism of each of the storing and feeding units in the banknote handling machine of the money handling system shown in FIG. 1.
Figure 9D:
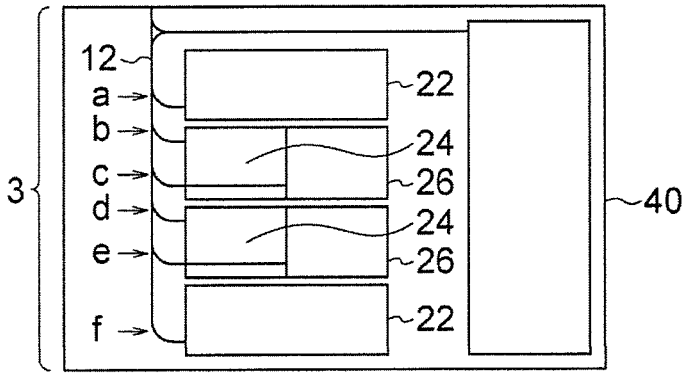
FIG. 9D is a view indicating the banknote denomination and the like linked with the banknote storing mechanism of each of the storing and feeding units in the banknote handling machine of the money handling system shown in FIG. 1.

In the banknote handling machine 1 according to the present embodiment, the storing and feeding unit 20 including the two banknote storing mechanisms 24 and 26 can be replaced with a storing and feeding unit 20 including the one banknote storing mechanism 22. As shown in FIG. 9C, when the second storing and feeding unit 20 from the top is replaced with the storing and feeding unit 20 including the one banknote storing mechanism 22, the denomination "c" previously assigned to the banknote storing mechanism 26 of the previous storing and feeding unit 20 is assigned to this banknote storing mechanism 22. More particularly, a denomination corresponding to the banknote storing mechanism 26 having a larger maximum storable banknote number among the banknote storing mechanism 24 and the banknote storing mechanism 26 in the original storing and feeding unit 20 is assigned to the banknote storing mechanism 22 of the storing and feeding unit 20 after the replacement. Accordingly, for example, when the denomination of the banknote recognized by the recognition unit 14 while the money deposition process of the banknote is being performed is the denomination "c" assigned to the original storing and feeding unit 20 (that is, 50 Euro), such a banknote is sent to the banknote storing mechanism 22 of the storing and feeding unit 20 after the replacement and stored in this banknote storing mechanism 22. On the other hand, when the denomination of the banknote recognized by the recognition unit 14 while the money deposition process of the banknote is being performed is the denomination "b" assigned to the original storing and feeding unit 20 (that is, 5 Euro), because no banknote storing mechanism exists that corresponds to the denomination "b" after the replacement of the storing and feeding unit 20 is performed, such a banknote is sent to the collecting unit 40 and stored in the banknote storage bag. As other example of the present embodiment, when the storing and feeding unit 20 including the two banknote storing mechanisms 24 and 26 is replaced with the storing and feeding unit 20 including the one banknote storing mechanism 22, setting about the denomination of each of the banknote storing mechanisms 22, 24, and 26 when such replacement of the storing and feeding unit 20 is performed can be previously performed in the controlling unit 50 so that a denomination corresponding to the banknote storing mechanism 24 having a smaller maximum storable banknote number among the banknote storing mechanism 24 and the banknote storing mechanism 26 in the original storing and feeding unit 20 is assigned to the banknote storing mechanism 22 of the storing and feeding unit 20 after the replacement.

In the banknote handling machine 1 according to the present embodiment, it is not necessary to assign each of the denominations a, b, c, d, e, and f to each of the banknote storing mechanisms 22, 24, and 26 in the four storing and feeding units 20. Instead of assigning each of the denominations a, b, c, d, e, and f to each of the banknote storing mechanisms 22, 24, and 26 in the four storing and feeding units 20, the denominations a, b, c, d, e, f can be assigned to the diversion points from the transport unit 12 to the banknote storing mechanisms 22, 24, and 26 of each of the storing and feeding units 20. The number of the diversion points from the transport unit 12 to the banknote storing mechanisms 22, 24, and 26 of each of the storing and feeding units 20 is equal to the maximum number of the banknote storing mechanisms 22, 24, and 26 that can be arranged in the banknote handling machine 1. Therefore, the act of performing the setting of assigning the denomination to each of the diversion point is analogues to, in the banknote handling machine 1 having a device configuration in which the number of the banknote storing mechanisms 22, 24, and 26 is maximum, the act of previously performing the setting of assigning the denomination to each of the banknote storing mechanisms 22, 24, and 26. Such an embodiment is explained by using FIG. 9D. As mentioned above, at every diversion point in the transport unit 12 is arranged the diverter 12*e* such as the diverting claw. Each of the denominations a, b, c, d, e, and f is assigned to the corresponding diversion point at which the transport unit 12 is diverted to the banknote storing mechanisms 22, 24, and 26 in the storing and feeding units 20. When the denomination of the banknote transported by the transport unit 12 matches with the denomination assigned to a certain diversion point, this banknote is diverted from the transport unit 12 by the corresponding diverter 12*e* and sent to the corresponding banknote storing mechanisms 22, 24, and 26 of the corresponding storing and feeding unit 20. Moreover, in this banknote handling machine 1, an insertion inlet 22*b* (see FIG. 5) of the banknote in the storing and feeding unit 20 including the one banknote storing mechanism 22 and the insertion inlet 26*b* of the banknote corresponding to the banknote storing mechanism 26 in the storing and feeding unit 20 including the two banknote storing mechanisms 24 and 26 are located at substantially the same height in the corresponding storing and feeding unit 20. When the storing and feeding unit 20 including the two banknote storing mechanisms 24 and 26 is replaced with the storing and feeding unit 20 including the one banknote storing mechanism 22, the insertion inlet 26*b* of the banknote corresponding to the banknote storing mechanism 26 in the storing and feeding unit 20 including the two banknote storing mechanisms 24 and 26 and the insertion inlet 22*b* of the banknote in the storing and feeding unit 20 including the one banknote storing mechanism 22 are connected to the same diversion point. Therefore, even if the storing and feeding unit 20 including the two banknote storing mechanisms 24 and 26 is replaced with the storing and feeding unit 20 including the one banknote storing mechanism 22, the denomination corresponding to the banknote storing mechanism 22 of the storing and feeding unit 20 after the replacement is assigned as is to the denomination set previously for the diversion point to which the banknote storing mechanism 22 is connected. A diversion point that was connected to the insertion inlet 24*b* of the banknote corresponding to the banknote storing mechanism 24 in the storing and feeding unit 20 that included the two banknote storing mechanisms 24 and 26 before such replacement has no insertion inlet to connect after the replacement. Therefore, the banknote of the denomination set previously corresponding to such a diversion point is sent to the collecting unit 40 and stored in the banknote storage bag.

The storing and feeding unit 20 (banknote storing device) and the banknote handling machine 1 including such a storing and feeding unit 20 according to the present embodiment are not limited to the embodiments mentioned above and can be changed as desired in various manner.

For example, the banknote handling machine 1 shown in FIG. 1 and the like is an example of a configuration in which the motors 28 and 29 are provided corresponding to the banknote storing mechanisms 24 and 26 in the storing and feeding unit 20 including the two banknote storing mechanisms 24 and 26; however, the configuration is not limited to this example. As another example, the motors 28 and 29 can be omitted from the storing and feeding unit 20. In this configuration, a power transmitted to the storing and feeding unit 20 from a body (for example, the transport unit 12) of the banknote handling machine 1 can be used to rotate the drums 24*a* and 26*a* and the reels 25*a*, 25*b*, 27*a*, and 27*b* of the banknote storing mechanisms 24 and 26.

Moreover, the banknote handling machine 1 shown in FIG. 1 and the like is an example of a configuration in which the plurality of (specifically two) banknote storing mechanisms 24 and 26 is provided in the second storing and feeding unit 20 from the top and the third storing and feeding unit 20 from the top among the four storing and feeding units 20; however, the configuration is not limited to this example. As another example, a banknote handling machine in which each of the storing and feeding units 20 includes the plurality of the banknote storing mechanisms 24 and 26 can be used. Moreover, a storing and feeding unit (banknote storing device) including three or more banknote storing mechanism can be used.

Moreover, in the storing and feeding unit 20 (banknote storing device) shown in FIGS. 1 to 9D, when viewed in the predetermined direction, which is the direction orthogonal to the depth direction of the casing 20*a* and also orthogonal to the axis direction of the drums 24*a* and 26*a* (rotating members), is taken as the height direction of the banknote handling machine 1; however, the configuration is not limited to this example. In another exemplary configuration of the storing and feeding unit (banknote storing device), an axis of a drum on which the banknotes are wound between tapes extends in a vertical direction so that the banknotes are stored on the drum vertically with respect to a horizontal plane. In this configuration, the predetermined direction in the storing and feeding unit (banknote storing device) extends horizontally (specifically, along the width direction of the banknote handling machine).

The banknote handling machine including the banknote storing device to which the principle according to the present invention is applied is not limited to the one having the configuration shown in FIG. 1 and the like. As the banknote handling machine including the banknote storing device to which the principle according to the present invention is applied, a machine dedicated for depositing banknotes, a machine dedicated for dispensing banknotes, an automatic teller machine (ATM), a money changer, and the like can be used.

Moreover, the principle of the storing and feeding unit 20 (banknote storing device) according to the present embodiment can be applied to a paper sheet storing device including a plurality of tape-reel style paper sheet storing mechanism each of which capable of storing paper sheets (for example, checks, gift certificates, and the like) other than the banknotes, and feeding the stored paper sheets. That is, in a paper sheet storing device that can store the paper sheets and feed the stored paper sheets, at least one of drums (rotating members) is arranged such that the drum does not overlap with any of reels (winding member accommodating unit) when viewed in a predetermined direction that is a direction orthogonal to a depth direction of a casing and also orthogonal to an axis direction of the drums.

What is claimed is:

1. A banknote storing device comprising:

a casing; and a plurality of banknote storing mechanisms arranged inside the casing side by side along a depth direction of the casing and each of which capable of storing banknotes sent from outside of the casing to inside thereof and feeding stored banknotes from the inside of the casing to the outside thereof, wherein each of the banknote storing mechanisms includes:

a rotating member that rotates around an axis orthogonal to the depth direction;

a plurality of belt-shaped winding members with each first end of two ends thereof connected to the rotating member; and a plurality of winding member accommodating units to which each second end of the two ends of the winding members is connected and that is capable of accommodating the winding members, and each of the banknote storing mechanisms stores therein the banknotes by winding the banknotes on the rotating member together with the plurality of winding members and feeds the banknotes one by one by unwinding the plurality of winding members wound on the rotating member from the rotating member, and at least one of the rotating members is arranged at a position at which the rotating member does not overlap with any of the winding member accommodating units when viewed in a predetermined direction orthogonal to the depth direction of the casing and also orthogonal to an axis direction of the rotating members, a plurality of insertion inlets for sending the banknote to each of the banknote storing mechanisms from the outside of the casing are arranged on a front side of the casing in a depth direction thereof such that the plurality of insertion inlets are aligned vertically, in at least one of the banknote storing mechanisms, the plurality of winding member accommodating units are arranged further inside in the depth direction of the casing than the rotating member to which the first end of each winding member is connected while the second end thereof is connected to the winding member accommodating units, an outer peripheral edge of each winding member wound on the rotating member when the maximum number of the banknotes are stored in the banknote storing mechanism overlaps at least partially with at least some of the winding member accommodating units in the depth direction of the casing, and a plurality of banknote transport mechanisms corresponding to each insertion inlet is disposed inside the casing, with each banknote transport mechanism sending the banknote from the insertion inlet to the banknote storing mechanism, an opening is arranged on a side of at least one of the banknote transport mechanisms in the casing such that the operator can see the banknote transport mechanism through the opening.

2. The banknote storing device as claimed in claim 1, wherein all the rotating members are arranged at positions at which the rotating members do not overlap with any of the winding member accommodating units in the predetermined direction.

3. The banknote storing device as claimed in claim 1, wherein each of the banknote storing mechanisms includes a driving unit that rotationally drives at least one of the rotating member and the winding member accommodating units, and at least one of the rotating members is arranged at a position at which the rotating member does not overlap with any of the driving units in the predetermined direction.

4. The banknote storing device as claimed in claim 1, wherein, in at least one of the banknote storing mechanisms, an outer peripheral edge of the winding members wound on the rotating member when a maximum number of the banknotes are stored in the banknote storing mechanism does not overlap with any of the winding member accommodating units in the predetermined direction.

5. The banknote storing device as claimed in claim 4, wherein, in all the banknote storing mechanisms, the outer peripheral edge of the winding members wound on the rotating member when the maximum number of the banknotes are stored in the banknote storing mechanism does not overlap with any of the winding member accommodating units in the predetermined direction.

6. The banknote storing device as claimed in claim 1, wherein each of the banknote storing mechanisms includes a driving unit that rotationally drives at least one of the rotating member and the winding member accommodating units, and in all the rotating members, an outer peripheral edge of the winding members wound on the rotating member when the maximum number of the banknotes are stored in the banknote storing mechanism overlaps at least partially with at least some of the driving units in the depth direction of the casing.

7. The banknote storing device as claimed in claim 1, wherein, in all the banknote storing mechanisms, the winding member accommodating units are arranged further inside in the depth direction of the casing than the rotating member to which is connected the first end of the winding members while the second end thereof is connected to the winding member accommodating units.

8. The banknote storing device as claimed in claim 1, wherein each of the banknote storing mechanisms includes a driving unit that rotationally drives at least one of the rotating member and the winding member accommodating units, and in at least one of the banknote storing mechanisms, the driving unit is arranged further inside in the depth direction of the casing than the rotating member that is rotationally driven by the driving unit.

9. The banknote storing device as claimed in claim 8, wherein all the driving units are arranged around the rotating member that is arranged further inside in the depth direction of the casing among the rotating members.

10. The banknote storing device as claimed in claim 1, wherein all the winding member accommodating units are arranged around the rotating member that is arranged further inside in the depth direction of the casing among the rotating members.

11. The banknote storing device as claimed in claim 1, wherein the casing has a substantially rectangular parallelepiped shape, a long-side direction of any rectangular side surface of the casing having a largest surface area corresponds to the depth direction of the casing, and the predetermined direction is a direction along a surface orthogonal to the axis direction of the rotating members and also a direction along a surface orthogonal to the long side of any rectangular side surface of the casing having the largest surface area.

12. The banknote storing device as claimed in claim 11, wherein two banknote storing mechanisms are arranged inside the casing, and a ratio of a length of a long side to a length of a short side of a side surface of the casing orthogonal to the axis direction of the rotating members is between 2 and 3.

13. The banknote storing device as claimed in claim 1, wherein a maximum number of the banknotes that is capable of being wound on the rotating member arranged further inside in the depth direction of the casing is larger than a maximum number of the banknotes that is capable of being wound on the rotating member arranged in a front side in the depth direction of the casing.

14. A banknote handling machine comprising:

a transport unit that transports banknotes; and the banknote storing device as claimed in claim 1, wherein the banknotes sent to the banknote storing device by the transport unit is stored in one of the banknote storing mechanisms, and banknotes fed from any one of the banknote storing mechanisms is sent to the transport unit.

15. The banknote handling machine as claimed in claim 14, wherein a plurality of banknote storing devices are arranged parallel to each other.

16. A banknote storing device comprising:

a casing having a plurality of insertion inlets;

a plurality of banknote storing mechanisms arranged inside the casing side by side along a depth direction of the casing, each of which is capable of storing banknotes sent from outside of the casing to inside thereof through the insertion inlets and feeding stored banknotes from the inside of the casing to the outside thereof;

a transport mechanism that transports the banknotes from one of the insertion inlets to the banknote storing mechanism arranged further inside in the depth direction of the casing among the banknote storing mechanisms, wherein each of the banknote storing mechanisms includes:

a rotating member that rotates around an axis orthogonal to the depth direction;

a belt-shaped winding member with a first end of two ends thereof connected to the rotating member; and a winding member accommodating unit to which a second end of the two ends of the winding member is connected and that is capable of accommodating the winding member, and each of the banknote storing mechanisms stores therein the banknotes by winding the banknotes on the rotating member together with the winding member and feeds the banknotes one by one by unwinding the winding member wound on the rotating member from the rotating member, and at least one of the rotating members is arranged at a position at which the rotating member does not overlap with any of the winding member accommodating units when viewed in a predetermined direction orthogonal to the depth direction of the casing and also orthogonal to an axis direction of the rotating members, and the transport mechanism overlaps at least partially with the banknote storing mechanism arranged at the front side in the depth direction of the casing among the banknote storing mechanisms in the predetermined direction, wherein the plurality of insertion inlets are configured to send the banknote to each of the banknote storing mechanisms from the outside of the casing and are arranged on a front side of the casing in a depth direction thereof, such that the plurality of insertion inlets are aligned vertically, and the plurality of banknote transport mechanisms corresponding to each insertion inlet is disposed in the casing, with each banknote transport mechanism sending the banknote from the insertion inlet to the banknote storing mechanism, an opening is arranged on a side of at least one of the transport mechanisms in the casing, such that the operator can see the banknote through the opening.

17. The banknote storing device as claimed in claim 16, wherein an opening and shutting guide is arranged in a bottom part of the banknote storing mechanism side in the transport mechanism.

18. A banknote storing device comprising:

a casing; and a plurality of banknote storing mechanisms arranged inside the casing side by side along a depth direction of the casing, each of which is capable of storing banknotes sent from outside of the casing to inside thereof and feeding stored banknotes from the inside of the casing to the outside thereof, wherein each of the banknote storing mechanisms includes:

a rotating member that rotates around an axis orthogonal to the depth direction;

a belt-shaped winding member with a first end of two ends thereof connected to the rotating member;

a winding member accommodating unit to which a second end of the two ends of the winding member is connected and that is capable of accommodating the winding member; and a pressing member that presses the banknotes, wound on the rotating member by the belt-shaped winding member, toward the rotating member, and each of the banknote storing mechanisms stores therein the banknotes by winding the banknotes on the rotating member together with the winding member and feeds the banknotes one by one by unwinding the winding member wound on the rotating member from the rotating member, in at least two of the plurality of banknote storing mechanisms, the pressing direction of the pressing member is different from each other, and at least one of the rotating members is arranged at a position at which the rotating member does not overlap with any of the winding member accommodating units when viewed in a predetermined direction orthogonal to the depth direction of the casing and also orthogonal to an axis direction of the rotating members, wherein the plurality of insertion inlets are configured to send the banknote to each of the banknote storing mechanisms from the outside of the casing and are arranged on a front side of the casing in a depth direction thereof, such that the plurality of insertion inlets are aligned vertically, and the plurality of banknote transport mechanisms corresponding to each insertion inlet is disposed in the casing, with each banknote transport mechanism sending the banknote from the insertion inlet to the banknote storing mechanism, an opening is arranged on a side of at least one of the transport mechanisms in the casing, such that the operator can see the banknote through the opening.

* * * * *